US005531150A

United States Patent [19]

Gegaregian et al.

[11] Patent Number: 5,531,150

[45] Date of Patent: Jul. 2, 1996

[54] LIGHTWEIGHT GUN SYSTEMS

[75] Inventors: Albert A. Gegaregian, Portola Valley; Vincenzo F. Costa, Milpitas; William L. Hendricks, San Jose; Milan G. Maximovich, Santa Cruz; Jacob Savitt, Belvedere; Hsiang-Sheng Shen, Saratoga; Michael R. Webber, Sunnyvale, all of Calif.

[73] Assignee: Lockheed Missiles & Space Company, Sunnyvale, Calif.

[21] Appl. No.: 240,052

[22] Filed: May 9, 1994

Related U.S. Application Data

[63] Continuation-in-part of Ser. No. 213,298, Mar. 14, 1994.

[51] Int. Cl.[6] ..... F41A 25/20; F41A 21/04; F41F 1/06

[52] U.S. Cl. ..... 89/15; 89/37.05; 89/43.01

[58] Field of Search ..... 42/76.02; 89/1.3, 89/1.35, 15, 16, 37.05, 37.13, 40.02, 43.01

[56] References Cited

U.S. PATENT DOCUMENTS

| | | | |
|---|---|---|---|
| 456,016 | 7/1891 | Canet . | |
| 461,347 | 10/1891 | Krone . | |
| 811,198 | 1/1906 | Burchardi . | |
| 1,471,063 | 10/1923 | Rognlie | 89/1.3 |
| 1,825,233 | 9/1931 | Joyce | 89/43.01 |
| 2,413,703 | 1/1947 | Fischer . | |
| 2,850,828 | 9/1958 | Sullivan . | |
| 2,973,694 | 3/1961 | Herlach et al. | 89/43.01 |
| 3,501,997 | 3/1970 | Winsen et al. . | |
| 3,517,585 | 6/1970 | Slade | 89/15 |
| 4,576,086 | 3/1986 | Brandt et al. . | |
| 4,685,236 | 8/1987 | May . | |
| 4,708,051 | 11/1987 | Argon | 89/40.02 |
| 4,724,740 | 2/1988 | Garcia . | |
| 4,841,836 | 6/1989 | Bundy . | |
| 4,911,060 | 3/1990 | Greenspan et al. . | |
| 5,191,165 | 3/1993 | Oskarsson et al. . | |
| 5,214,234 | 5/1993 | Divecha et al. . | |

FOREIGN PATENT DOCUMENTS

| | | | |
|---|---|---|---|
| 319617 | 3/1902 | France . | |
| 792740 | 10/1934 | France . | |
| 1269185 | 7/1961 | France | 89/37.05 |
| 2525940 | 11/1975 | Germany . | |
| 126353 | 5/1919 | United Kingdom | 89/1.3 |
| 462509 | 3/1937 | United Kingdom | 89/37.05 |
| 1113281 | 6/1964 | United Kingdom . | |

*Primary Examiner*—Stephen C. Bentley
*Attorney, Agent, or Firm*—Oblon, Spivak, McClelland, Maier & Neustadt

[57] ABSTRACT

A mortar design according to the present invention has been described. The mortar of the present invention weighs substantially less than the presently available mortars. Furthermore, the mortar of the present invention provides a dampening mechanism which substantially dampens the movement of the entire mortar assembly during firing of rounds.

43 Claims, 19 Drawing Sheets

FIG 4 A

Wind over titanium tube w/ M40J/584 1/8" tape

| LAYER | STATION 27.00 | 27.75 | 28.50 | 29.25 | 30.00 | 30.75 | 31.50 | 32.25 | 33.00 | 33.75 | 34.50 | 35.25 | 36.00 | 40.19 | 44.38 | 48.58 | 52.77 | 56.96 | 61.16 | 65.35 |
|---|---|---|---|---|---|---|---|---|---|---|---|---|---|---|---|---|---|---|---|---|
| 1 | 30 | 30 | 30 | 30 | 30 | 30 | 30 | 30 | 30 | 30 | 30 | 30 | 30 | 30 | 30 | 30 | 30 | 30 | 30 | 30 |
| 2 | -30 | -30 | -30 | -30 | -30 | -30 | -30 | -30 | -30 | -30 | -30 | -30 | -30 | -30 | -30 | -30 | -30 | -30 | -30 | -30 |
| 3 | 30 | 30 | 30 | 30 | 30 | 30 | 30 | 30 | 30 | 30 | 30 | 30 | 30 | 30 | 30 | 30 | 30 | 30 | 30 | 30 |
| 4 | -30 | -30 | -30 | -30 | -30 | -30 | -30 | -30 | -30 | -30 | -30 | -30 | -30 | -30 | -30 | -30 | -30 | -30 | -30 | -30 |
| 5 | 30 | 30 | 30 | 30 | 30 | 30 | 30 | 30 | 30 | 30 | 30 | 30 | 30 | 30 | 30 | 30 | 30 | 30 | 30 | 30 |
| 6 | -30 | -30 | -30 | -30 | -30 | -30 | -30 | -30 | -30 | -30 | -30 | -30 | -30 | -30 | -30 | -30 | -30 | -30 | -30 | -30 |
| 7 | 90 | 90 | 90 | 90 | 90 | 90 | 90 | 90 | 90 | 90 | 90 | 90 | 90 | 90 | 90 | 90 | 90 | 90 | 90 | 90 |
| 8 | 90 | 90 | 90 | 90 | 90 | 90 | 90 | 90 | 90 | 90 | 90 | 90 | 90 | 90 | 90 | 90 | 90 | 90 | 90 | 90 |
| 9 | 90 | 90 | 90 | 90 | 90 | 90 | 90 | 90 | 90 | 90 | 90 | 90 | 90 | 90 | 90 | 90 | 90 | 90 | 90 | 90 |
| 10 | 90 | 90 | 90 | 90 | 90 | 90 | 90 | 90 | 90 | 90 | 90 | 90 | 90 | 90 | 90 | 90 | 90 | 90 | 90 | 90 |
| 11 | 90 | 90 | 90 | 90 | 90 | 90 | 90 | 90 | 90 | 90 | 90 | 90 | 90 | 90 | 90 | 90 | 90 | 90 | 90 | 90 |
| 12 | 90 | 90 | 90 | 90 | 90 | 90 | 90 | 90 | 90 | 90 | 90 | 90 | 90 | 90 | 90 | 90 | 90 | 90 | 90 | 90 |
| 13 | 90 | 90 | 90 | 90 | 90 | 90 | 90 | 90 | 90 | 90 | 90 | 90 | 90 | 90 | 90 | 90 | 90 | 90 | | |
| 14 | 90 | 90 | 90 | 90 | 90 | 90 | 90 | 90 | 90 | 90 | 90 | 90 | 90 | 90 | 90 | 90 | 90 | 90 | | |
| 15 | 90 | 90 | 90 | 90 | 90 | 90 | 90 | 90 | 90 | 90 | 90 | 90 | 90 | 90 | 90 | 90 | | | | |
| 16 | 90 | 90 | 90 | 90 | 90 | 90 | 90 | 90 | 90 | 90 | 90 | 90 | 90 | 90 | 90 | 90 | | | | |
| 17 | 90 | 90 | 90 | 90 | 90 | 90 | 90 | 90 | 90 | 90 | 90 | 90 | 90 | 90 | | | | | | |
| 18 | 90 | 90 | 90 | 90 | 90 | 90 | 90 | 90 | 90 | 90 | 90 | 90 | 90 | 90 | | | | | | |
| 19 | 90 | 90 | 90 | 90 | 90 | 90 | 90 | 90 | 90 | 90 | 90 | 90 | | | | | | | | |
| 20 | 90 | 90 | 90 | 90 | 90 | 90 | 90 | 90 | 90 | 90 | 90 | 90 | | | | | | | | |
| 21 | 90 | 90 | 90 | 90 | 90 | 90 | 90 | 90 | 90 | 90 | | | | | | | | | | |
| 22 | 90 | 90 | 90 | 90 | 90 | 90 | 90 | 90 | 90 | 90 | | | | | | | | | | |
| 23 | 90 | 90 | 90 | 90 | 90 | 90 | 90 | 90 | | | | | | | | | | | | |
| 24 | 90 | 90 | 90 | 90 | 90 | 90 | 90 | 90 | | | | | | | | | | | | |
| 25 | 90 | 90 | 90 | 90 | 90 | 90 | | | | | | | | | | | | | | |
| 26 | 90 | 90 | 90 | 90 | 90 | 90 | | | | | | | | | | | | | | |
| 27 | 90 | 90 | 90 | 90 | | | | | | | | | | | | | | | | |
| 28 | 90 | 90 | 90 | 90 | | | | | | | | | | | | | | | | |
| 29 | 90 | 90 | | | | | | | | | | | | | | | | | | |
| 30 | 90 | 90 | | | | | | | | | | | | | | | | | | |
| 31 | 90 | | | | | | | | | | | | | | | | | | | |
| 32 | 30 | 30 | 30 | 30 | 30 | | | | | | | | | | | | | | | |
| 33 | -30 | -30 | -30 | -30 | -30 | | | | | | | | | | | | | | | |
| 34 | 30 | 30 | 30 | 30 | 30 | 30 | 30 | 30 | 30 | 30 | | | | | | | | | | |
| 35 | -30 | -30 | -30 | -30 | -30 | -30 | -30 | -30 | -30 | -30 | | | | | | | | | | |

FIG_4B

Wind over titanium tube w/ M40j/584 1/8" tape

| LAYER | STATION 27.00 | 27.75 | 28.50 | 29.25 | 30.00 | 30.75 | 31.50 | 32.25 | 33.00 | 33.75 | 34.50 | 35.25 | 36.00 | 40.19 | 44.38 | 48.58 | 52.77 | 56.96 | 61.16 | 65.35 |
|---|---|---|---|---|---|---|---|---|---|---|---|---|---|---|---|---|---|---|---|---|
| 36 | 90 | | | | | | | | | | | | | | | | | | | |
| 37 | 90 | 90 | | | | | | | | | | | | | | | | | | |
| 38 | 90 | 90 | | | | | | | | | | | | | | | | | | |
| 39 | 90 | 90 | 90 | 90 | | | | | | | | | | | | | | | | |
| 40 | 90 | 90 | 90 | 90 | | | | | | | | | | | | | | | | |
| 41 | 90 | 90 | 90 | 90 | 90 | 90 | | | | | | | | | | | | | | |
| 42 | 90 | 90 | 90 | 90 | 90 | 90 | | | | | | | | | | | | | | |
| 43 | 90 | 90 | 90 | 90 | 90 | 90 | 90 | 90 | | | | | | | | | | | | |
| 44 | 90 | 90 | 90 | 90 | 90 | 90 | 90 | 90 | | | | | | | | | | | | |
| 45 | 90 | 90 | 90 | 90 | 90 | 90 | 90 | 90 | 90 | 90 | | | | | | | | | | |
| 46 | 90 | 90 | 90 | 90 | 90 | 90 | 90 | 90 | 90 | 90 | | | | | | | | | | |
| 47 | 90 | 90 | 90 | 90 | 90 | 90 | 90 | 90 | 90 | 90 | 90 | 90 | | | | | | | | |
| 48 | 90 | 90 | 90 | 90 | 90 | 90 | 90 | 90 | 90 | 90 | 90 | 90 | | | | | | | | |
| 49 | 90 | 90 | 90 | 90 | 90 | 90 | 90 | 90 | 90 | 90 | 90 | 90 | 90 | 90 | | | | | | |
| 50 | 90 | 90 | 90 | 90 | 90 | 90 | 90 | 90 | 90 | 90 | 90 | 90 | 90 | 90 | | | | | | |
| 51 | 90 | 90 | 90 | 90 | 90 | 90 | 90 | 90 | 90 | 90 | 90 | 90 | 90 | 90 | 90 | 90 | | | | |
| 52 | 90 | 90 | 90 | 90 | 90 | 90 | 90 | 90 | 90 | 90 | 90 | 90 | 90 | 90 | 90 | 90 | | | | |
| 53 | 90 | 90 | 90 | 90 | 90 | 90 | 90 | 90 | 90 | 90 | 90 | 90 | 90 | 90 | 90 | 90 | 90 | 90 | | |
| 54 | 90 | 90 | 90 | 90 | 90 | 90 | 90 | 90 | 90 | 90 | 90 | 90 | 90 | 90 | 90 | 90 | 90 | 90 | | |
| 55 | 90 | 90 | 90 | 90 | 90 | 90 | 90 | 90 | 90 | 90 | 90 | 90 | 90 | 90 | 90 | 90 | 90 | 90 | 90 | 90 |
| 56 | 90 | 90 | 90 | 90 | 90 | 90 | 90 | 90 | 90 | 90 | 90 | 90 | 90 | 90 | 90 | 90 | 90 | 90 | 90 | 90 |
| 57 | 90 | 90 | 90 | 90 | 90 | 90 | 90 | 90 | 90 | 90 | 90 | 90 | 90 | 90 | 90 | 90 | 90 | 90 | 90 | 90 |
| 58 | 90 | 90 | 90 | 90 | 90 | 90 | 90 | 90 | 90 | 90 | 90 | 90 | 90 | 90 | 90 | 90 | 90 | 90 | 90 | 90 |
| 59 | 90 | 90 | 90 | 90 | 90 | 90 | 90 | 90 | 90 | 90 | 90 | 90 | 90 | 90 | 90 | 90 | 90 | 90 | 90 | 90 |
| | [ LOCAL BUILDUP OF 90 DEG PLIES BEFORE FINAL +30 DEG AT THIS POINT ] | | | | | | | | | | | | | | | | | | | |
| 60 | -30 | -30 | -30 | -30 | -30 | -30 | -30 | -30 | -30 | -30 | -30 | | | | | | | | | |
| 61 | 30 | 30 | 30 | 30 | 30 | 30 | 30 | 30 | 30 | 30 | 30 | | | | | | | | | |
| 62 | -30 | -30 | -30 | -30 | | | | | | | | | | | | | | | | |
| 63 | 30 | 30 | 30 | 30 | | | | | | | | | | | | | | | | |
| 64 | 90 | 90 | 90 | 90 | 90 | 90 | 90 | 90 | 90 | 90 | 90 | 90 | 90 | 90 | 90 | 90 | 90 | 90 | 90 | 90 |
| 65 | -30 | -30 | -30 | -30 | -30 | -30 | -30 | -30 | -30 | -30 | -30 | -30 | -30 | -30 | -30 | -30 | -30 | -30 | -30 | -30 |
| 66 | 30 | 30 | 30 | 30 | 30 | 30 | 30 | 30 | 30 | 30 | 30 | 30 | 30 | 30 | 30 | 30 | 30 | 30 | 30 | 30 |
| 67 | -30 | -30 | -30 | -30 | -30 | -30 | -30 | -30 | -30 | -30 | -30 | -30 | -30 | -30 | -30 | -30 | -30 | -30 | -30 | -30 |
| 68 | 30 | 30 | 30 | 30 | 30 | 30 | 30 | 30 | 30 | 30 | 30 | 30 | 30 | 30 | 30 | 30 | 30 | 30 | 30 | 30 |
| 69 | -30 | -30 | -30 | -30 | -30 | -30 | -30 | -30 | -30 | -30 | -30 | -30 | -30 | -30 | -30 | -30 | -30 | -30 | -30 | -30 |
| 70 | 30 | 30 | 30 | 30 | 30 | 30 | 30 | 30 | 30 | 30 | 30 | 30 | 30 | 30 | 30 | 30 | 30 | 30 | 30 | 30 |

FIG_18
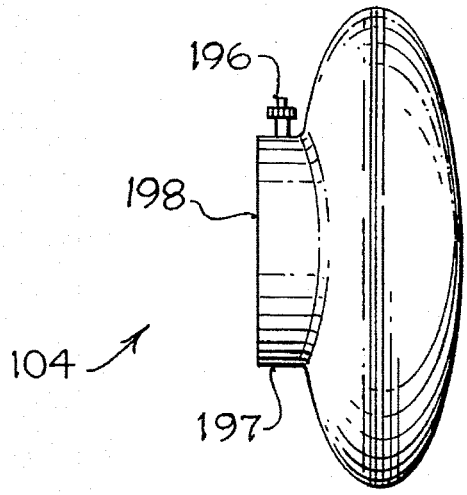
FIG_20
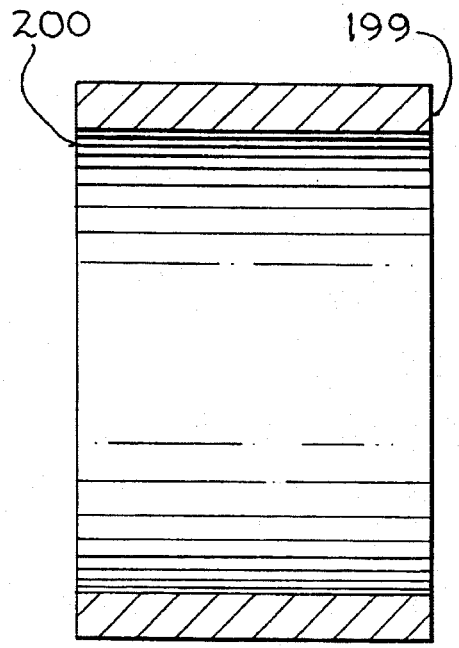
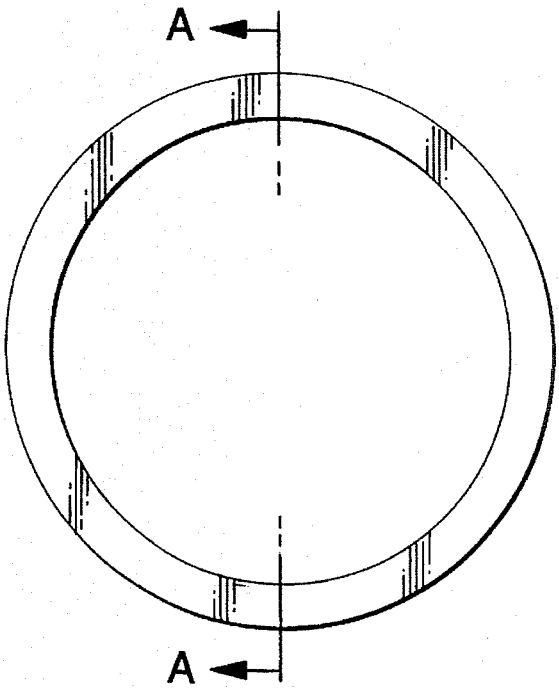
FIG_19

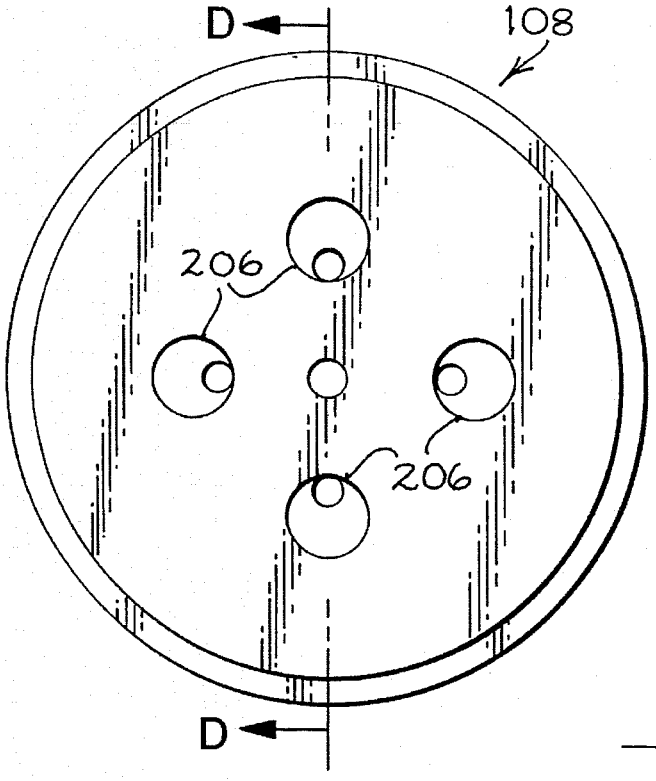
FIG_21
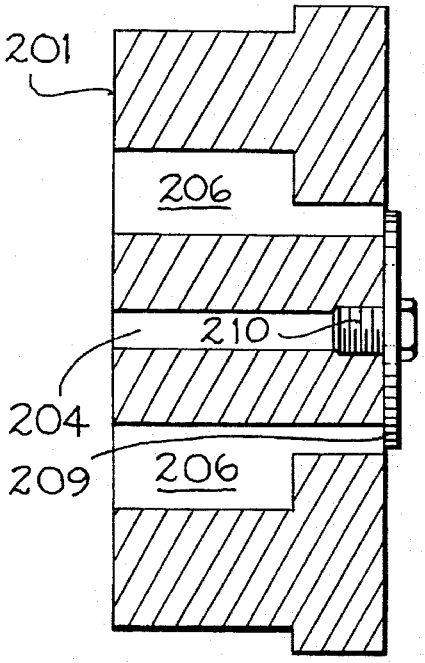
FIG_22
FIG_23
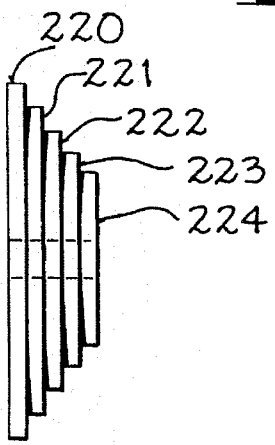
FIG_25
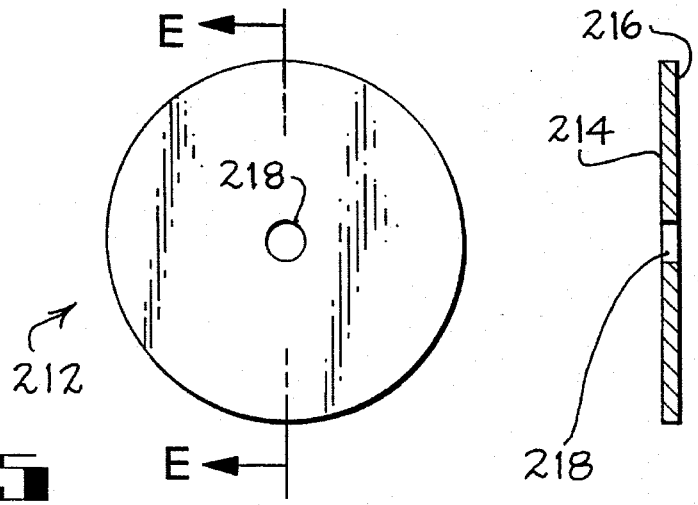
FIG_24

LIGHTWEIGHT GUN SYSTEMS

RELATIONSHIP TO COPENDING APPLICATION

This application is a continuation-in-part of copending application Ser. No. 08/213,298, filed Mar. 14, 1994, the entire content of which is incorporated herein by reference.

FIELD OF THE INVENTION

The present invention deals with military equipment. Specifically, the present invention deals with the design of a substantially lighter gun systems, such as lightweight mortars.

BACKGROUND OF THE INVENTION

Lightweight gun systems are being increasingly the preferred choice of the military establishments. The lighter the gun, the less total gun weight that needs to be transported. This is a tremendous advantage where the gun systems must be transported to difficult climates. Mortars are one example of guns used in the military. They provide the capability of shooting rounds at targets at medium ranges. 120 mm mortars are an example of such a mortar system. FIG. 1 illustrates a 120 mm mortar assembly currently in use. Mortar assembly 2 includes barrel 4, breech piece 5, bipod 6, and base-plate 8. Barrel 4 is angled up and down to shoot the round at the desired trajectory. The lower end of the barrel 4 is externally threaded to take the breech piece 5. The breech piece holds the striker. The striker is a fixed stud on which the bomb falls under gravity. The lower end of the breech piece is shaped into a ball (not shown) which enters a socket in the base plate 8.

Bipod 6 functions as a support and means to adjust the angle of trajectory. This is achieved by adjusting the angle that barrel 4 makes with the ground. It also provides the means to hold barrel 4 at a proper angle. Base-plate 8 is a heavy welded steel dish. It has socket 10 at the center to take the breech piece. This provides the capability to rotate the barrel 4 around a full 360 without shifting the base-plate.

Similar to base-plate 8, barrel 4 and bipod 6 are also made of steel. Current mortars take advantage of important attributes of steel. However, there are disadvantages associated with the use of steel as the main material for manufacturing the mortars. For example, 120 mm mortars made of steel are very heavy and require a team to transport each piece. Typical prior art 120 mm mortars weigh between 272 kg and 341 kg in the traveling configuration. This creates problems when these mortars can no longer be carried by machine and must be carried by humans. In these situations, the 120 mm mortars must be dismantled and transported part by part. This requires at least 3 to 4 people to carry all the parts. Furthermore, in situations where time is of the essence and the rounds must be fired continuously, dismantling and re-assembling the mortars may not be practical.

Another problem with the current 120 mm mortars is that there is no mechanism to reduce the recoil force and absorb the recoil energy of the mortar assembly after each round is fired. Presently, sand bags are placed under and around base-plate 8 to absorb the recoil movement of mortar 2. Despite this, present 120 mm mortars on a non-absorbing surface may jump as high as 3 to 4 feet off the ground. This poses a clear danger to the mortar operators. As a consequence, mortars are either placed on absorbing surfaces such as soft ground or sandbags and may have extra bags placed on the mount to reduce rebound effects. The recoil problem is even greater with a light mortar such as the mortar of the present invention.

In view of the above, it is clearly seen that there is a need for lightweight gun systems, such as lightweight mortars. Furthermore, there is a need for gun systems with dampers that can substantially reduce the recoil force and absorb the recoil energy of the gun system caused by firing rounds.

OBJECTS AND SUMMARY OF THE INVENTION

It is an objective of the present invention to provide a lightweight gun system, specifically a lightweight mortar system.

It is also an objective of the present invention to provide lightweight gun systems capable of firing only one round. It is also an objective of the present invention to provide lightweight gun systems capable of firing more than one round.

It is also the objective of the present invention to provide a gun system having a damper mechanism which is capable of substantially reducing the recoil force and absorbing the recoil energy of the mortar after each round of firing.

Furthermore, it is the objective of the present invention to provide a damper that returns the barrel of the gun system back to the initial firing position before launching of another round.

A gun system according to the present invention includes a barrel, a dampening mechanism coupled to the barrel, a breech fitting section coupled between the barrel and the dampening mechanism. In a first embodiment, the barrel of the present invention includes two layers. It includes a liner and an outer sleeve. In order to reduce the weight of the system, the present invention utilizes lightweight metals and composite materials to build the system. In particular, the liner is made of titanium, the outer sleeve is made of composite materials, and the rest of the system is made of aluminum.

The barrel of the present invention offers an abrasion resistant inside surface. It further provides a strong, thermally stable, and thermally conductive outer sleeve.

In a second embodiment of the barrel of the present invention, it includes a cylindrical sleeve.

The dampening mechanism used in the present invention converts the kinetic energy of the barrel caused by the explosion to heat energy and releases heat to the environment through the walls of its housing. It also provides a mechanism to return the displaced barrel to its original position after the exposure charge has been fired. Furthermore, it reduces the recoil force exerted on the base and the ground in response to each round of firing.

The ensuing section provides the detailed description of the present invention.

BRIEF DESCRIPTION OF THE DRAWINGS

FIG. 4 is an example of winding sequences to make the outer sleeve of a barrel according to the present invention.

FIG. 13 is a cross-sectional view of the first embodiment of the upper closure used in the damper of the present invention.

FIG. 18 illustrates a bladder bag used in the damper of the present invention.

FIG. 19 is an end view of the spacer used in the damper of the present invention.

FIG. 20 is a cross-sectional view of the spacer of FIG. 19, taken along the line C—C.

FIG. 21 is an end view of the metering block used in the damper of the present invention.

FIG. 22 is a cross-sectional view of metering block of FIG. 21, taken along the line D—D.

FIG. 23 is an end view of a typical metal spring plate used in the present invention, FIG. 24 is a cross-sectional view of the spring plate of FIG. 23 taken along the line E—E.

FIG. 25 is an example of a high pressure spring.

DETAILED DESCRIPTION OF THE INVENTION

The present invention applies to gun systems in general, and in particular to lightweight gun systems. A gun system according to the present invention is substantially lighter than the present comparable gun system. It further has a damper mechanism that substantially reduces the recoil force and absorbs the recoil energy of the system after each round of firing. The present invention relates to both muzzle loading gun systems and breech loading gun systems, and systems are intended to be included in the invention. For clarity of presentation, the invention will be presented hereinafter with respect to muzzle loading systems, and in particular to a lightweight mortar system. However, it should be emphasized that the present invention apply equally to other gun systems.

Figure 1:
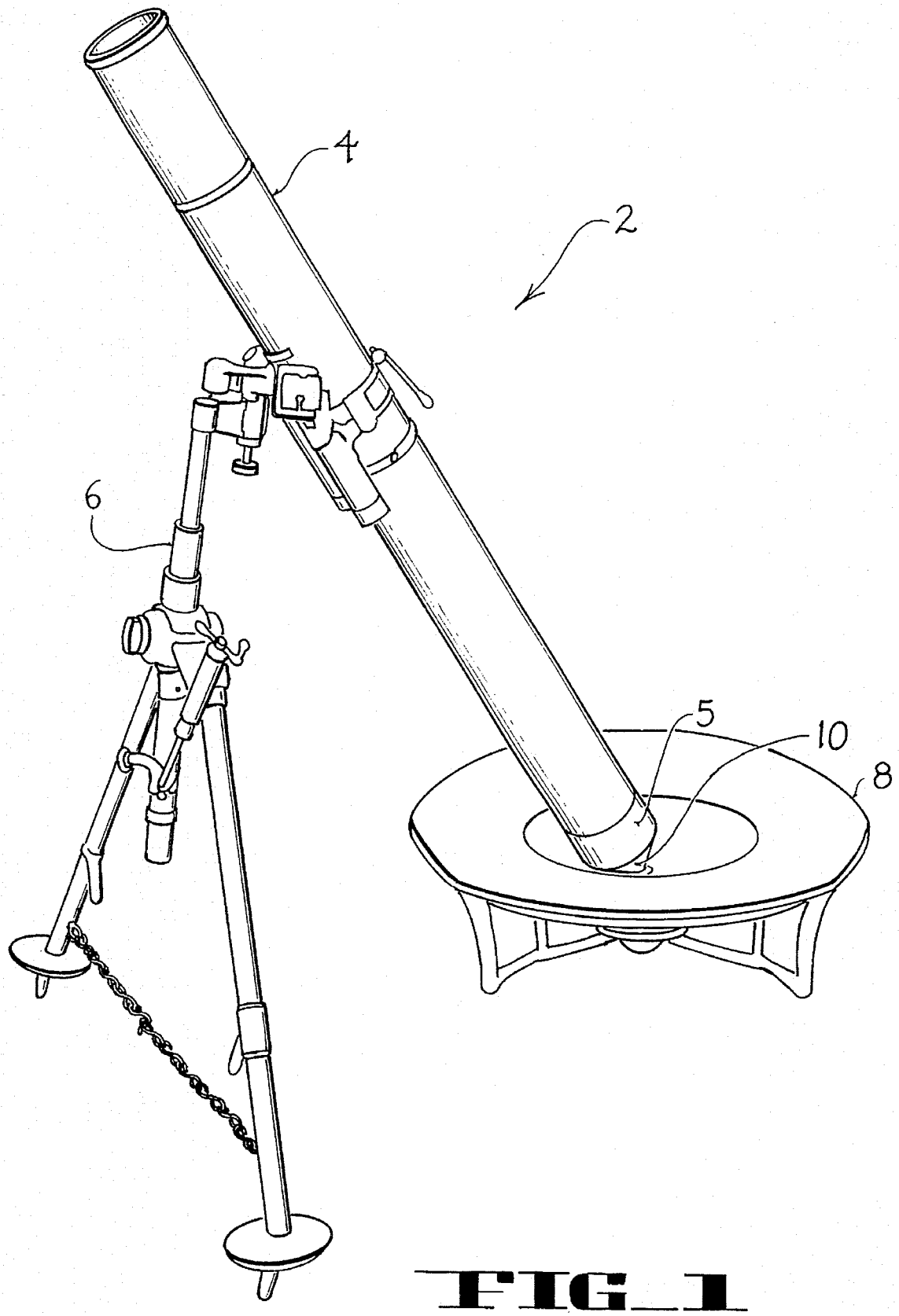
FIG 1 PRIOR ART
FIG. 1 illustrates an example of a prior art mortar system.
Figure 2:
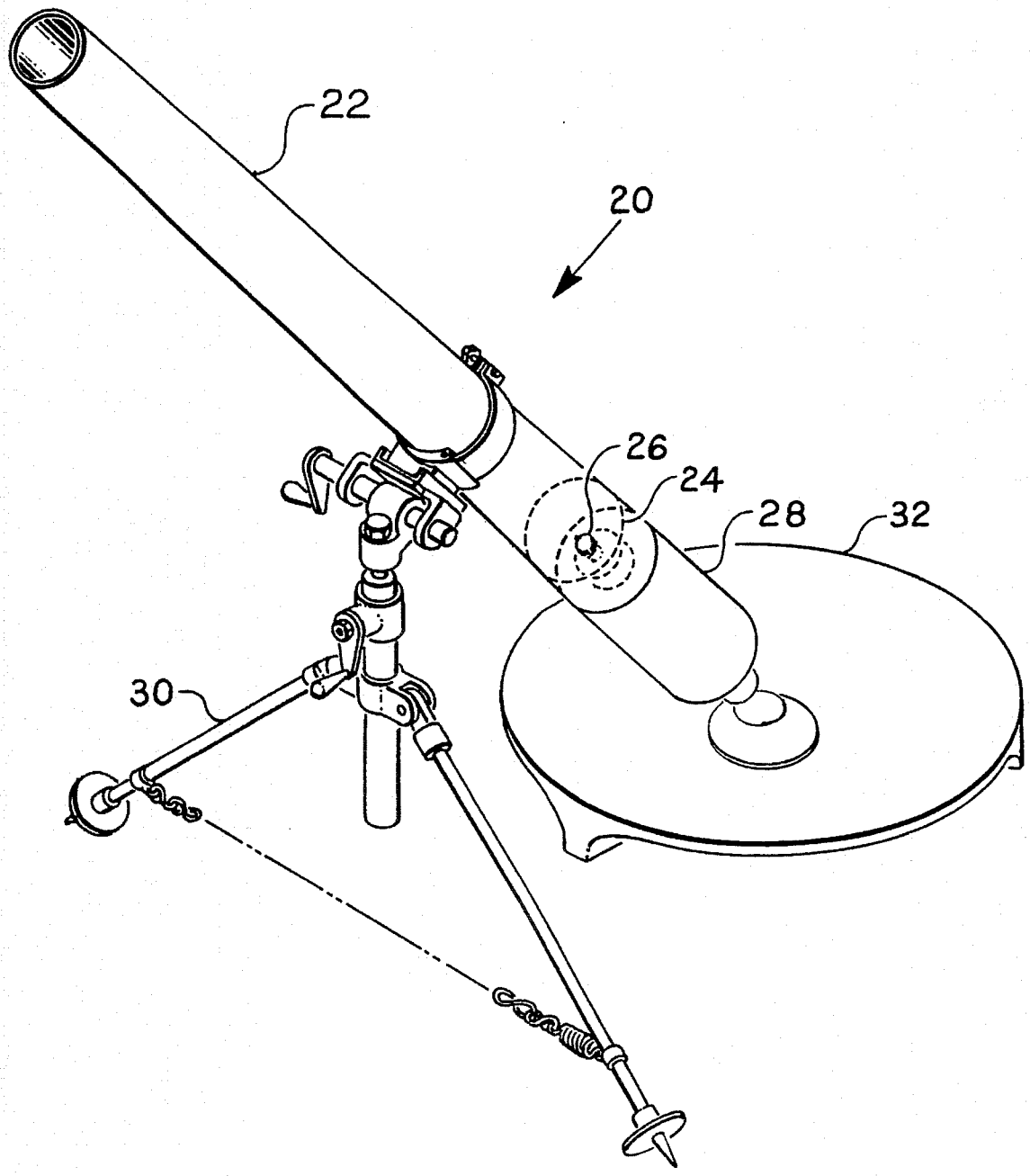
FIG. 2 is a schematic view of a mortar according to the present invention.

FIG. 2 is a schematic view of a mortar according to the present invention. Mortar 20 includes barrel 22, breech fitting 24, firing pin 26, damper 28, bipod 30, and base-plate 32. Breech fitting 24 is positioned in the bottom end of barrel 22. It connects barrel 22 to damper 28. Barrel 22 includes muzzle 50 and bottom side 52. Breech or breech fitting 24 is axially aligned with barrel 22 and connects to bottom side 52. The other side of breech fitting 24 connects to one side of damper 28 such that damper 28 is axially aligned with barrel 22. Firing pin 26 resides inside the breech fitting/damper assembly. It is a fixed stud on which the bomb falls under gravity. The lower end of damper 28 is connected to base plate 32. Bipod 30 is used to support barrel 22 at a specified trajectory angle. The individual parts of mortar 20 are made of lightweight materials in order to substantially reduce its total weight.

For example, a 120 mm mortar according to the present invention weighs about 60% less than the presently available steel 120 mm mortars. Each of the barrel/damper assembly, bipod, and base-plate of a 120 mm mortar, according to the present invention, weighs less than 40 pounds. Thus, a 120 mm mortar can be dismantled and moved by 3 people over long distances.

Damper 28 is provided to substantially reduce the recoil force and absorb the recoil movement of barrel 22 during each round. It also provides a mechanism to return barrel 22 to its original position after each round for further shots. The operation of damper 28 will be further discussed later. Next, the individual parts of mortar 20 will be described.

Figure 3:
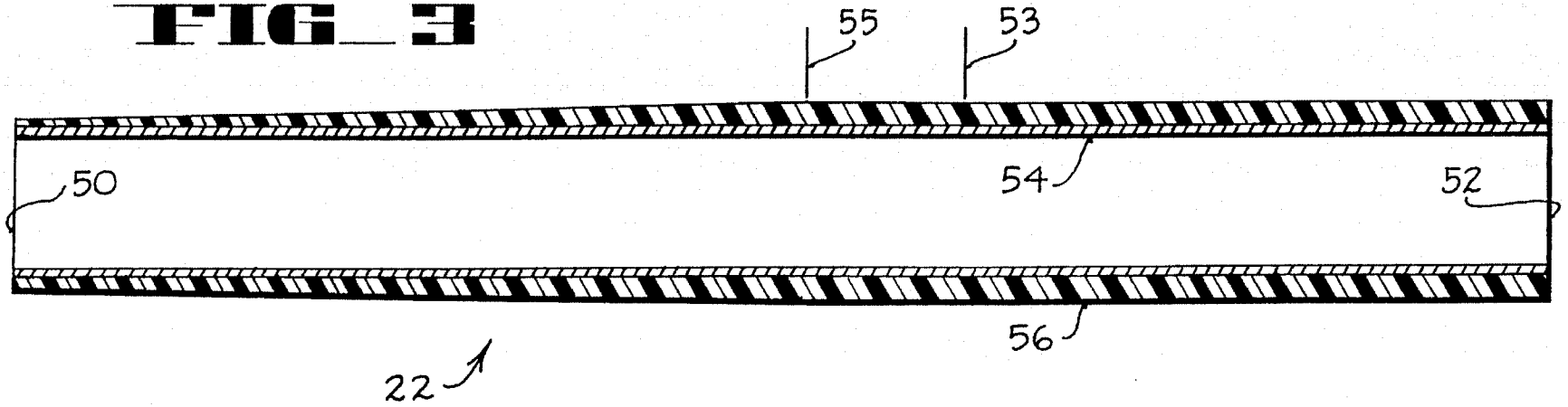
FIG. 3 is a cross-sectional view of a first embodiment of the barrel of the present invention.

FIG. 3 is a cross-sectional view of barrel 22 of the present invention. As mentioned above, barrel 22 includes muzzle 50 and bottom side 52. Barrel 22 further includes two layers, a cylindrical liner 54 which is enclosed within an outer sleeve 56. Rounds exit barrel 22 through muzzle 50. The structure of barrel 22 is uniquely different from the structure of the steel barrels in the presently available mortars. The barrels in the presently available mortars are a tube made of a single thickness of steel. The steel barrels are very heavy which makes them hard to transport from one location to the next. On the other hand, barrel 22 weighs substantially less than steel barrels and are much easier to transport from one location to the next.

To reduce the total weight of barrel 22, liner 54 and outer sleeve 56 are made of lightweight materials. However, these materials must be selected such that the performance of the resulting barrel closely resembles the performance of the steel barrel. A steel barrel has an abrasion resistant inside surface. The surface does not chip or scratch as the rounds collide with it on their way out. Steel further provides the necessary strength so that the barrel can withstand an enormous pressure caused by the propellant explosion during each round. Finally, the steel provides the necessary thermal stability and heat conduction. The thermal stability of the steel prevents radial expansion of the barrel as temperature increases. Excessive radial expansion of the barrel could result in firing rounds at an angle different from the intended angle. Steel is also a good thermal conductor, dissipating the heat generated by the propellant explosion.

In the present invention, liner 54 can be composed of a number of hard surfaced heat conductors selected from the group containing titanium, Silicon Carbide Particulate Alumina ($SiCp/Al_2O_3$), Carbon reinforced Silicon Carbide (C/SiC), and Silicon Carbide reinforced Carbon (SiC/C). It is preferably made of titanium. This attribute of titanium enables the fabrication of a liner 54 with an abrasion resistant inside surface. Therefore, similar to the steel barrels, the inside surface of barrel 22 resists chipping as the rounds collide with it on their way out.

Silicon Carbide Particulate Alumina is produced by oxidizing aluminum at a high temperature and adding pieces of silicon carbide to the oxidized aluminum. The silicon carbide pieces add more ductility to the oxidized aluminum.

Outer sleeve 56 is made of strips of composite material which are wound around liner 54. This process is repeated until the desired thickness of outer sleeve 56 is achieved. The composite material weighs substantially less than steel, but provides the necessary strength. The strength is necessary since outer sleeve 56 must withstand a tremendous amount of pressure during each round of firing. As mentioned above, the pressure is created when the propellant inside the cap of each round explodes.

The composite material is formed of graphite carbon filaments impregnated with a thermally stable organic polymer formed into a flexible tape. One method of forming the composite is to pass the carbon filaments through a bath of organic polymer. In this process, mechanical bonds are created between the molecules of carbon filament and the molecules of the organic polymer, The molecules of the organic polymer fill the gaps between the molecules of the carbon filaments. The resulting composite material takes advantage of the properties of both the carbon filaments and the organic polymer. Other methods of forming the composite are within the scope of the present invention, some of which will be described below.

The carbon filaments provides the tensile strength and thermal stability of the resulting composite material. There are different categories of carbon which are distinguished based on their properties. Among those properties are strength and rigidness of the carbon. These two properties are essential in the present invention since outer sleeve 56 must be sufficiently strong to withstand the pressure and sufficiently rigid to resist radial expansion. In the present invention, M4Oj carbon filament is preferably used to form the composite. Other materials functioning similar to carbon could also be used to form the composite.

Once the composite material is cured, the weakest link is the bond between the organic polymer and carbon molecules. This bond breaks if the temperature of outer sleeve 56 exceeds the maximum operating temperature of the organic polymer. The maximum operating temperature of the organic polymer is the temperature in which it no longer provides the above-mentioned properties. The maximum temperature of outer sleeve 56 is directly proportional to the number of rounds per minute fired by mortar 20. As the number of rounds per minute increases, the temperature of barrel 22, and consequently the temperature of outer sleeve 56, increases. Therefore, as the required number of rounds per minute increases, higher temperature organic polymers must be used to form the composite.

Table 1 lists different organic polymers that can be used to form the above-mentioned composite. These materials are listed in ascending order of their maximum operating temperature. All these materials are readily available from different manufacturers. For example, PMR-15, AFR 7008, and TRW 800D can be obtained from U.S. Polymeric Corporation or Hexcel Corporation.

TABLE 1

| Matrix Resin | Temperature |
|---|---|
| Epoxy Cyanate Ester | To 350° F. |
| Bismaleimide | 350 to 500° F. |
| Phenyl Triazine | |
| PMR-15 | 500 to 600° F. |
| AFR 700B, TRW 800D | 600 to 700° F. |

As mentioned above, outer sleeve 56 is formed by winding layers of composite tape around liner 54 as the liner is turned about its axis. The composite tape is wound at a specific angle in each layer. It is possible that all layers are wound at one angle. FIG. 4 illustrates the 70 layer winding sequence for a 120 mm mortar manufactured according to the present invention. Other methods forming sleeve 56 include hand lay-up method. Hand lay-up method includes the application of the impregnated tape to the liner using simple tools or manufacturing aids.

Resin Transfer Molding method includes placing liner 54 and a preform in a suitable mold. The preform includes reinforcing carbon fibers which are shaped like a cylindrical sleeve. Next, a high temperature organic polymer resin is injected into the mold under the pressure. The organic polymer fully impregnates the carbon preform and wets the liner surface. The entire assembly is then cured to form sleeve 56 around liner 54.

Pultrusion method includes passing liner 54 and carbon fibers through a bath of organic polymer. The polymer coats the liner and impregnates the fibers. In this method, curing can be accomplished in the latter stages of pultrusion, either through the application of heat or radiation.

As can be seen on the top row in FIG. 4, the length of barrel 54 is partitioned into stations. Below the 36 inch point, the length of liner 54 is partitioned into 0.75 inch stations. Above the 36 inch point, the length of liner 54 is partitioned into 4.19 inch stations. Since winding sequences of the stations below 27 inches are exactly the same as station 27, they are omitted in the table of FIG. 4.

Each row in the table of FIG. 4 represents one layer, and each column represents the number of layers in one station. For example, station 27 has 72 layers of composite tape, each wound at a specified angle. Station 36 has a total of 42 layers of composite tape, each wound at a specified angle. A particular entry in each box where a row crosses a column represents the angle in which the composite material is to be wound around a particular station. These angles are measured relative to a plane passing through central axis 58 of barrel 22, as shown in FIG. 3. The plane passing through central axis 58 represents 0° angle. All the other angles are measured with respect to this plane in counterclockwise direction. For example, the first layer for all stations is wound at a 30° angle and the 10th layer for all stations is wound at −30°, i.e. 150°, angle.

The reason for winding the composite layers at different angles is to ensure that outer sleeve 56 is capable of withstanding the stress that is produced by the internal pressure of barrel 22 from different angles. Otherwise, if the composite tape is wound only at one angle, for example 90 degrees, the axial and bending components of the total stress would cause barrel 22 to rupture.

Returning to FIG. 3, it shows outer sleeve 56 having three different radial thicknesses. Outer sleeve 56 has a constant radial thickness from bottom 52 to point 53. The radial thickness between points 53 and 55 tapers at a first angle. The radial thickness between point 55 and muzzle 50 tapers at a second angle. In the embodiment of FIG. 3, the second angle is steeper than the first angle. The section located between bottom 52 and point 53 forms the part of barrel 22 in which the explosion of the propellant occurs. Therefore, it is constantly subjected to a tremendous amount of pressure. Accordingly, the radial thickness of this section must be maximized to withstand the pressure of the explosion. On the other hand, since the pressure felt by the inside surface of barrel 22 drops as we approach muzzle 50, the radial thickness of outer sleeve 56 can decrease. Therefore, the radial thickness of outer sleeve 56 tapers down starting from point 53. The tapered radial thickness structure weighs less than a uniform thickness structure. This enables the present invention to reduce the mass and weight of barrel 22 without compromising its performance. The resulting outer sleeve 56 can withstand a tremendous amount of pressure, even though it is light in weight.

Figure 5:
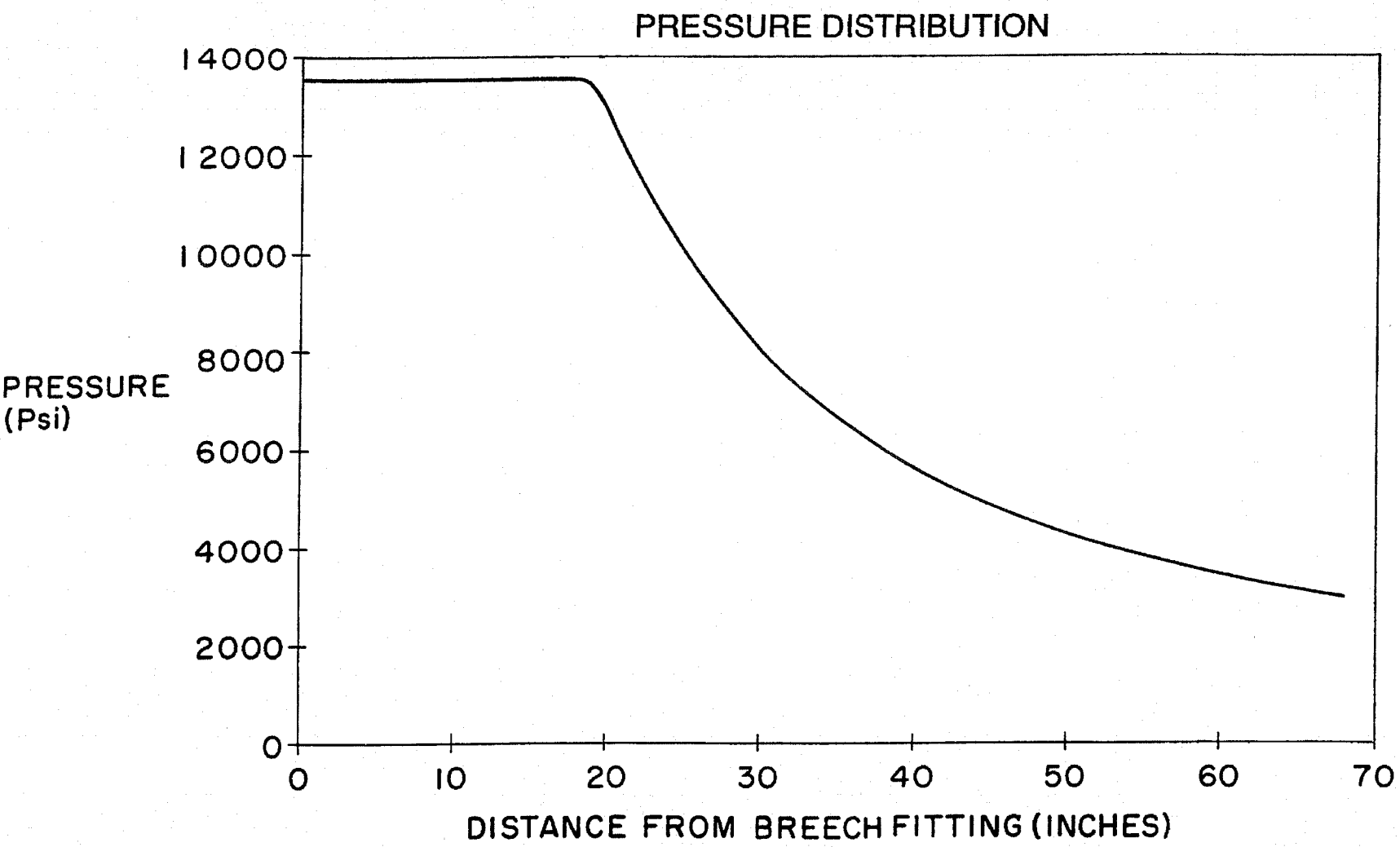
FIG. 5 illustrates a pressure-distance graph depicting the result of a computer simulation of the barrel of the present invention.

FIG. 5 is a graph showing the gas pressure in the barrel versus the distance from breech fitting 24 during each round of firing. The data in this graph has been obtained from a computer simulation of a 120 mm mortar. The simulator simulates an explosion inside barrel 22 during a round of firing. The graph in FIG. 5 shows that the inner gas pressure exerted on barrel 22 is above 13,000 pounds per square inch ("psi") up to 20 inches distance from breech fitting 24. Above the 20 inch point, the pressure decreases exponentially. The information in FIG. 5 further supports the multi thickness design of outer sleeve 56. Point 53 falls on the 25 inch point for a 120 mm mortar according to the present invention.

In addition to the strength requirement, outer sleeve 56 must also be thermally stable in view of a tremendous amount of heat generated by the explosion. The thermal stability of outer sleeve 56 prevents excessive radial expansion of barrel 22. As explained above, the excessive radial expansion could result in deviations of a trajectory angle from the desired angle. Furthermore, outer sleeve 56 must be a good thermal conductor to prevent overheating of barrel 22. However, the composite material used to fabricate outer sleeve 56 is not a good thermal conductor. This means that outer sleeve 56 of barrel 22 does not conduct the heat as well as the steel barrel. However, this difference is apparent only during the first few rounds of firing. Once three or four rounds have been fired, the temperature gradient of outer sleeve 56 follows the temperature gradient of the steel barrel. Thus, in operation, outer sleeve 56 provides sufficient thermal conductivity to resemble the operation of mortars with steel barrels.

Barrel 22 of FIG. 3 can be used in mortar systems which are capable of firing more than one round. As mentioned before, as the number of rounds per minute increases, so does the overall temperature of barrel 22. Thus, in the present invention, as the operating temperature requirement of barrel 22 increases, higher temperature organic polymers must be utilized in forming the composite. Accordingly, barrels which are capable of firing more rounds can be designed by selecting the appropriate organic polymer.

For example, if Epoxy Cyanate Ester is used, the resulting barrel can be used to fire four rounds. Then, there must be adequate time lapse before the next four rounds can be fired. This allows barrel 22 to cool down. On the other hand, if the PMR-15 (refer to table 1) is used, the resulting barrel is capable of firing 12 rounds in the first minute and four rounds per minute thereafter, continuously.

Figure 6:
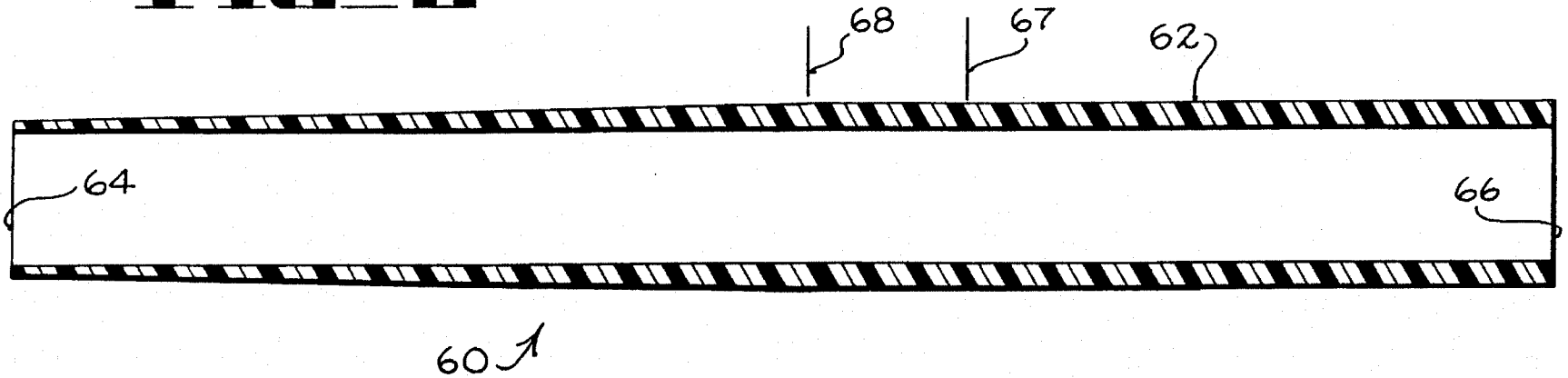
FIG. 6 is a cross-sectional view of a second embodiment of the barrel according to the present invention.

FIG. 6 shows barrel 60 which is designed for mortar systems used to fire only once. Barrel 60 includes cylindrical sleeve 62 which is fabricated exactly like outer sleeve 56 of barrel 22. Barrel 60 further includes muzzle 64 and bottom side 66.

Since barrel 60 is used in a mortar system which fires only once, there is no need to provide an abrasion resistant inside surface. Therefore, there is no need for a liner as used in the design of barrel 22 (FIG. 3). Elimination of the liner reduces the weight of the barrel, and ultimately, the weight of the mortar system.

Similar to outer sleeve 56, cylindrical sleeve 62 has a tapered structure. This reduces the weight of barrel 60. Cylindrical sleeve 62 is fabricated using carbon filaments and organic polymer adhesive material formed as a composite tape. The organic polymer is chosen such that it can withstand the heat generated by the explosion of the propellant of one round.

To fabricate cylindrical sleeve 62, composite tape is wound around a tube rotating about its central axis. Upon the completion of the fabrication process, the tube is slid out of cylindrical sleeve 62. Similar to fabrication of outer sleeve 56, composite tape is wound around the tube at different angles. This ensures that the resulting cylindrical sleeve 62 can withstand the stress produced by the internal pressure of barrel 22.

The resulting cylindrical sleeve 62 is strong and is thermally stable. It has a tapered structure to reduce its weight. It has a constant radial thickness between bottom side 66 and point 67. Its radial thickness then tapers at a first angle between points 67 and 68. Finally, its radial thickness tapers at a second angle between points 68 and muzzle 64. In the embodiment of FIG. 6, the second angle is steeper than the first angle. Higher radial thickness is provided in the region between bottom side 66 and point 67 to enable it to withstand the pressure during firing of the round.

Figure 8:
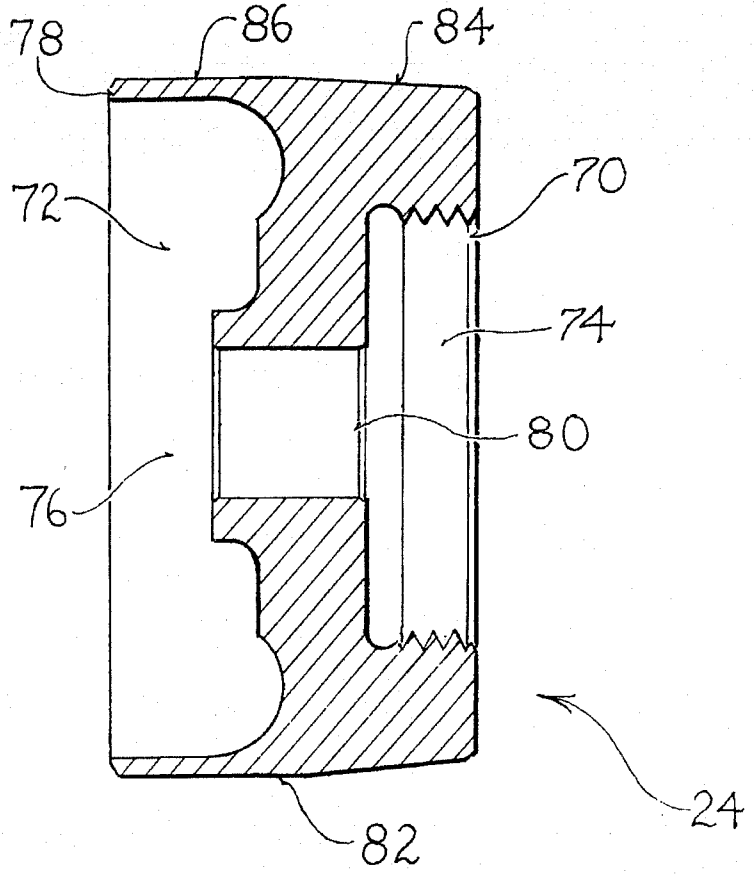
FIG. 8 is a cross-sectional view of the breech fitting of FIG. 7, taken along the line A—A.
Figure 7:
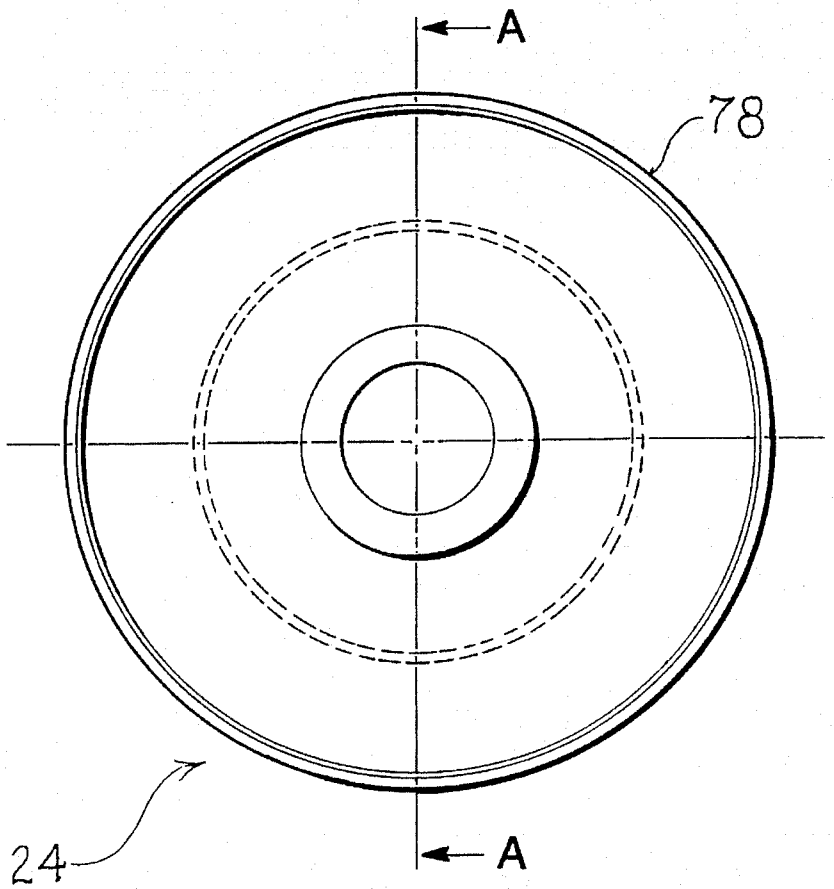
FIG. 7 illustrates the breech fitting of the present invention.

In order to connect barrel 22 or 60 to damper 28, the present invention utilizes a breech fitting 24. Referring to FIGS. 7 and 8, two views of breech fitting 24 are illustrated. FIG. 7 is the frontal view, and FIG. 8 is the cross-sectional side view of breech fitting 24 taken along the line A—A in FIG. 7. As shown in FIG. 8, breech fitting 24 is a solid cylindrical section having a first side 70 and a second side 72. On side 70, breech fitting 24 includes a circular recess 74 having a threaded inside surface. On side 72, breech fitting 24 includes a second recess 76. Recess 76 leaves side 72 with a narrow circular surface 78. Breech fitting 24 further includes a central space 80 which extends from the bottom of circular recess 74 to the bottom of recess 76. The outside surface 82 of breech fitting 24 includes a tapered section 84 and a non-tapered section 86. The tapered section begins approximately from the middle of outside surface 82 and ends at side 70.

Figure 9:
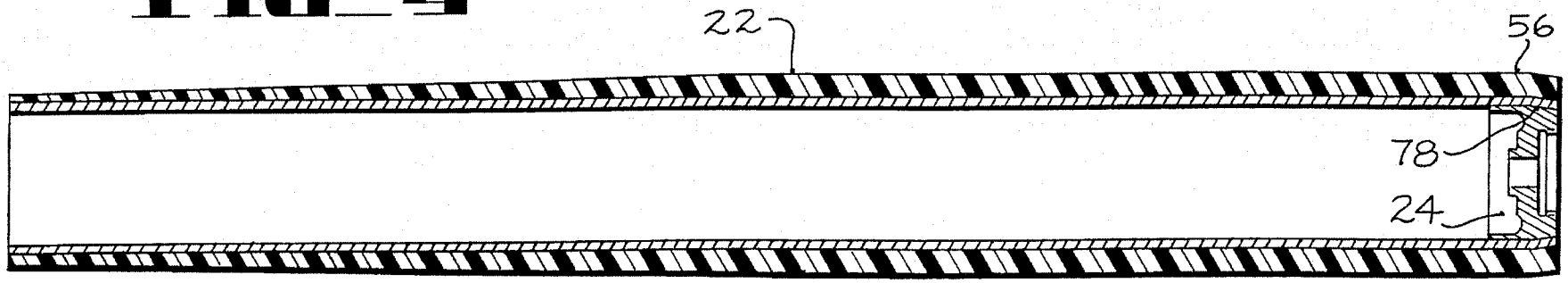
FIG. 9 is a cross-sectional view of the assembled breech fitting and barrel of FIG. 3.

Breech fitting 24 provides the means to connect barrel 22 to damper 28 (FIG. 2). Surface 78 welds to liner 54 such that both breech fitting 24 and barrel 22 are axially aligned, as seen in FIG. 9. The other side of breech fitting 24 mates with damper 28. Tapered section 84 provides the means to prevent outer sleeve 56 (FIG. 3) from sliding in the direction of outgoing rounds after the explosion. This will be described later.

FIG. 9 is a cross-sectional view of barrel 22 bonded to surface 78 of breech fitting 24. It further illustrates that the outside surface of breech fitting 24 is covered by outer sleeve 56.

Figure 10:
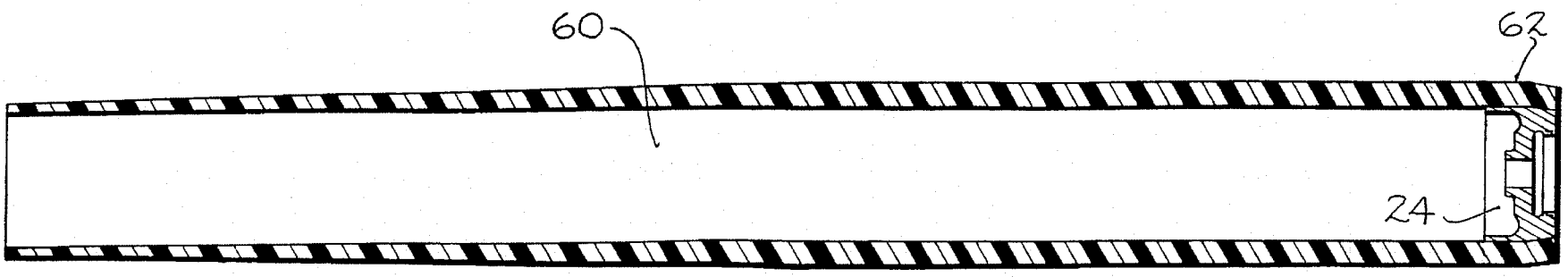
FIG. 10 is a cross-sectional view of the assembled breech fitting and barrel of FIG. 6.

Breech fitting 24 also provides the means to connect barrel 60 to damper 28 (FIG. 2). One method of connecting breech fitting 24 to cylindrical sleeve 60 is to use adhesive material. This is shown in FIG. 10. The adhesive material posses similar characteristics as the organic polymers used to form the composite. The adhesive material is applied to outside surface 82 of breech fitting 24. The adhesive cause the inside surface of cylindrical sleeve 66 and outside surface 82 to bond and connect. The bonding between the two surfaces is sufficiently strong to withstand the pressure caused on round of firing.

Figure 11:
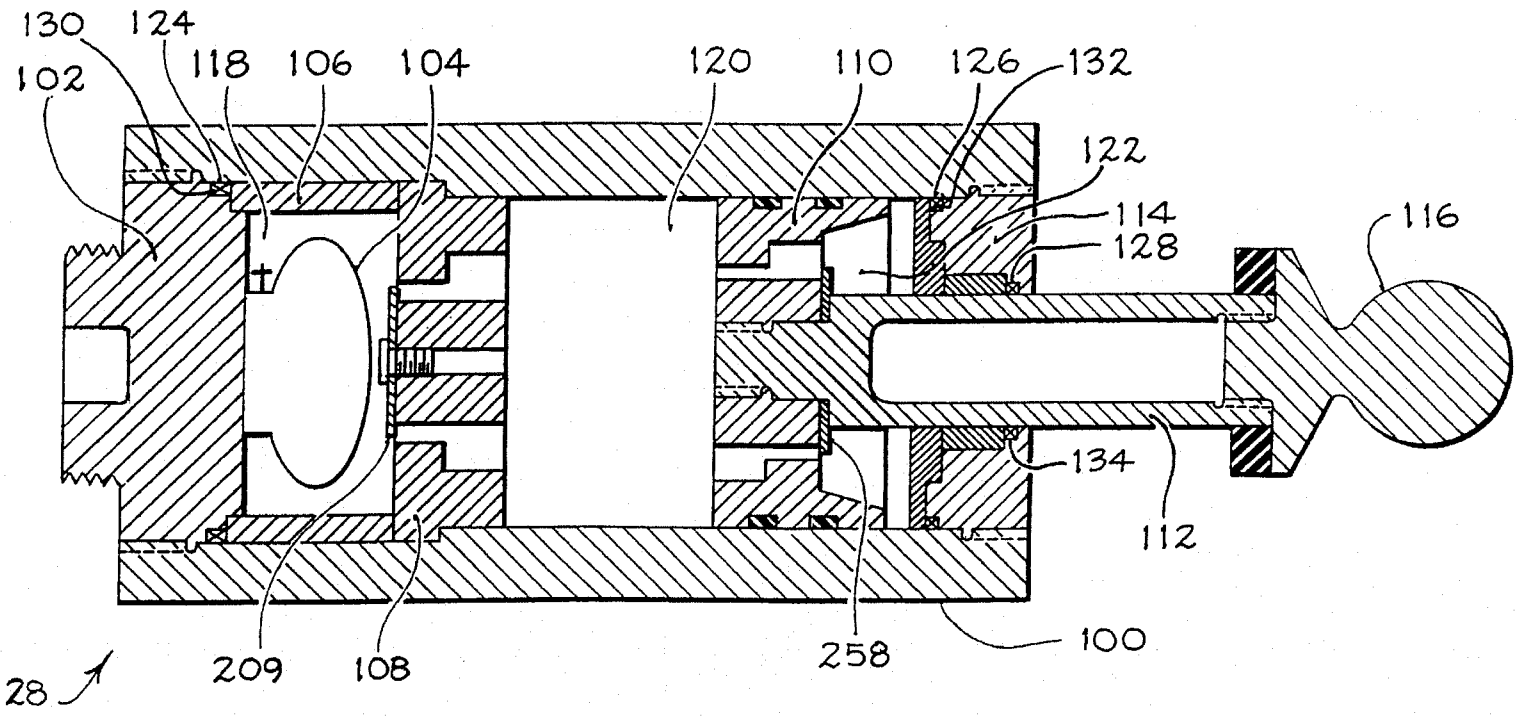
FIG. 11 is a cross-sectional view of a damper according to the present invention.

FIG. 11 is a cross-sectional view of damper 28 of the present invention. Damper 28 includes pressure cylinder 100, upper closure or upper cap 102, air bladder 104, spacer 106, metering block 108, piston 110, piston shaft 112, bottom closure or bottom cap 114, ball 116, and seals 124–128. Damper 28 further includes spaces 118–122 and recesses 130-134. Recess 130 houses seal 124, recess 132 houses seal 126, and recess 134 houses seal 136. In order to be operative, spaces 118–122 must be filled with liquid media. The liquid media is the basis of viscous damping and converts the kinetic energy of barrel 22 to heat. In the present invention, spaces 118–122 are filled with an oil.

Figure 12:
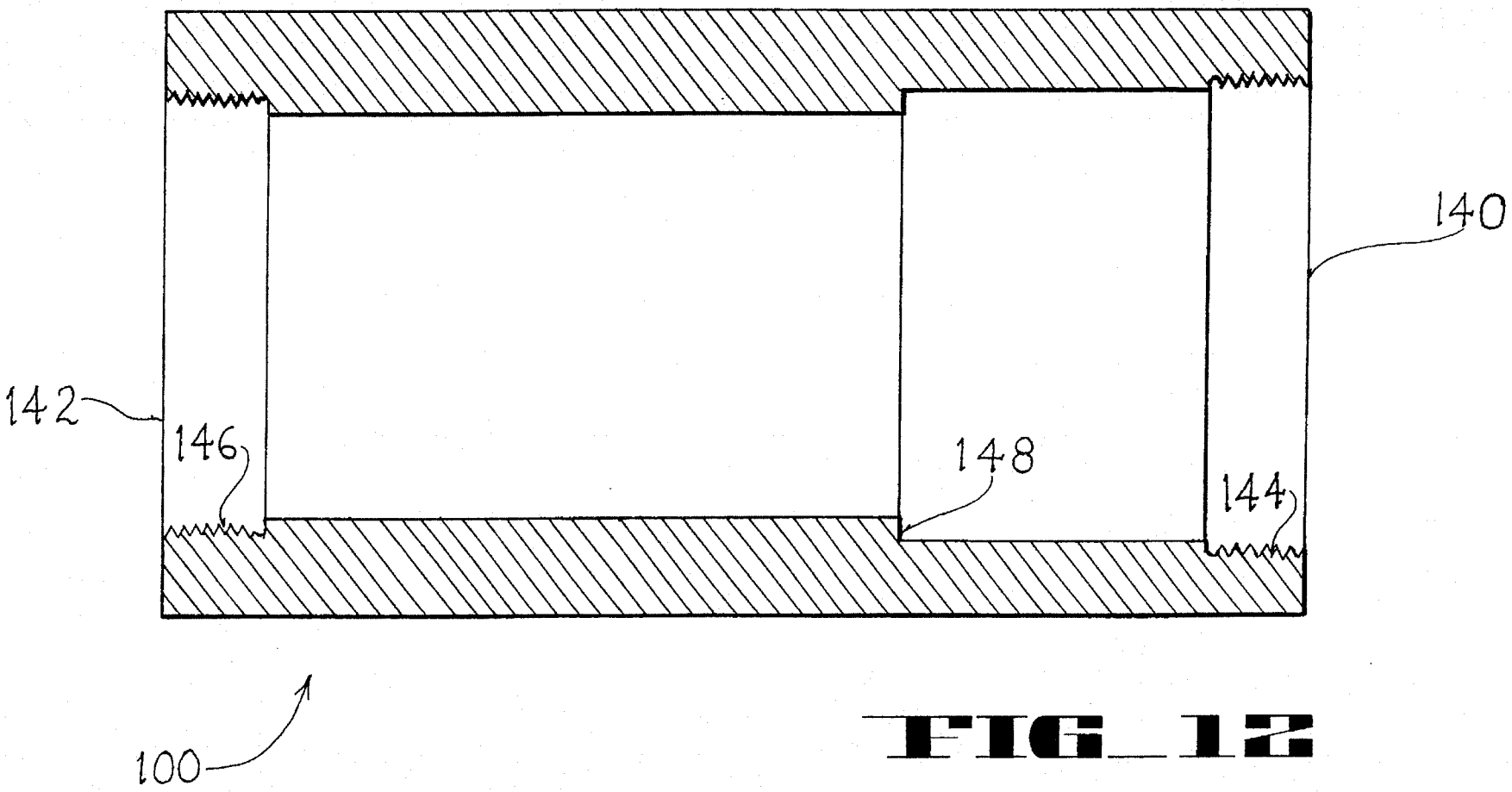
FIG. 12 is a cross-sectional view of the pressure cylinder used in the damper of the present invention.

Pressure cylinder 100 is shown in FIG. 12. It is a cylindrical housing which has two ends, 140 and 142. End 140 includes threaded section 144 which mates with upper closure 102. End 142 includes threaded section 146 which mates with bottom closure 114. Pressure cylinder 100 further includes annular surface 148 which receives one surface of metering block 108.

Figure 14:
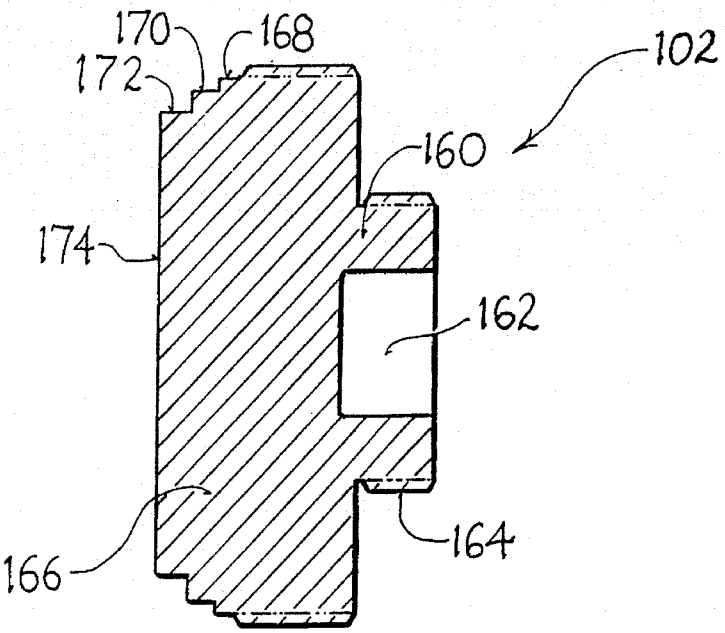
FIG. 14 is an lower end of the upper closure shown in FIG. 13.

A first embodiment of upper closure 102 is shown in FIGS. 13 and 14. FIG. 13 is the frontal view, and FIG. 14 is a cross-sectional view taken along the line B—B in FIG. 13. Upper closure 102 includes a protruding circular section 160 and a solid cylindrical section 166. Protruding section 160 includes a circular recess 162, which extends the entire length of section 160 and slightly penetrates section 166. Section 160 further includes mating threads 164 on its outer surface. The outside surface of Section 166 is partially threaded and has annular surfaces 168, 170 and 172.

Recess 162 houses part of firing pin 26 (FIG. 2). Surface 168 is used as a guide surface. As section 166 enters end 140 of pressure cylinder 100, from side 174, surface 168 slides against the inside surface of pressure cylinder 100. This ensures that upper closure 102 is centered as the threaded section of section 166 mates with threaded section 144. This way both pressure cylinder 100 and upper closure 102 are axially aligned. Surface 172 receives one side of spacer 106. As spacer 106 and upper closure 102 mate, recess 130 (FIG. 11) which includes surface 170 is created. As mentioned before, recess 130 houses seal 124. Seal 124 seals the connection between pressure cylinder 100 and upper closure 102. In the present invention, seal 124 is a lip seal.

Figure 15:
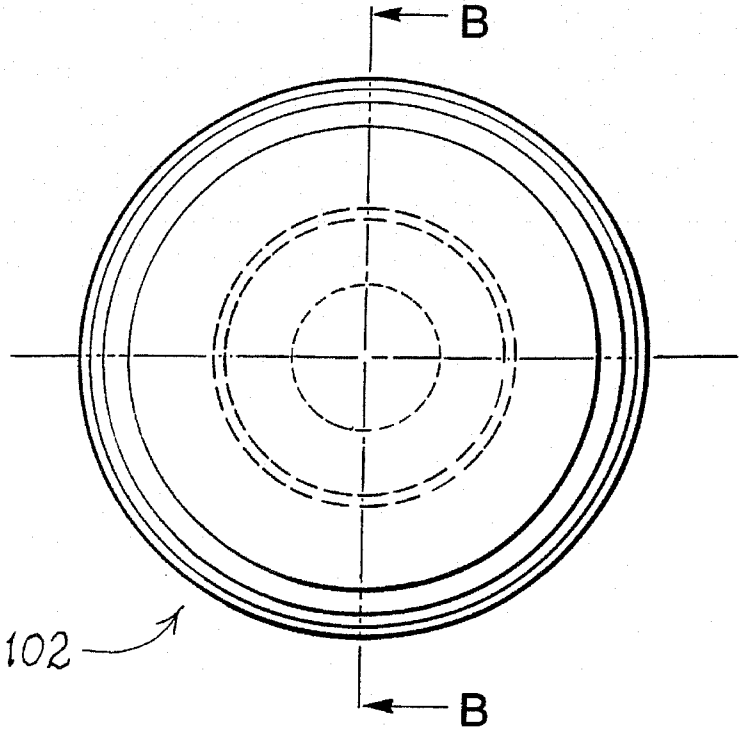
FIG. 15 is a cross-sectional view of the second embodiment of the upper closure used in the damper of the present invention.
Figure 16:
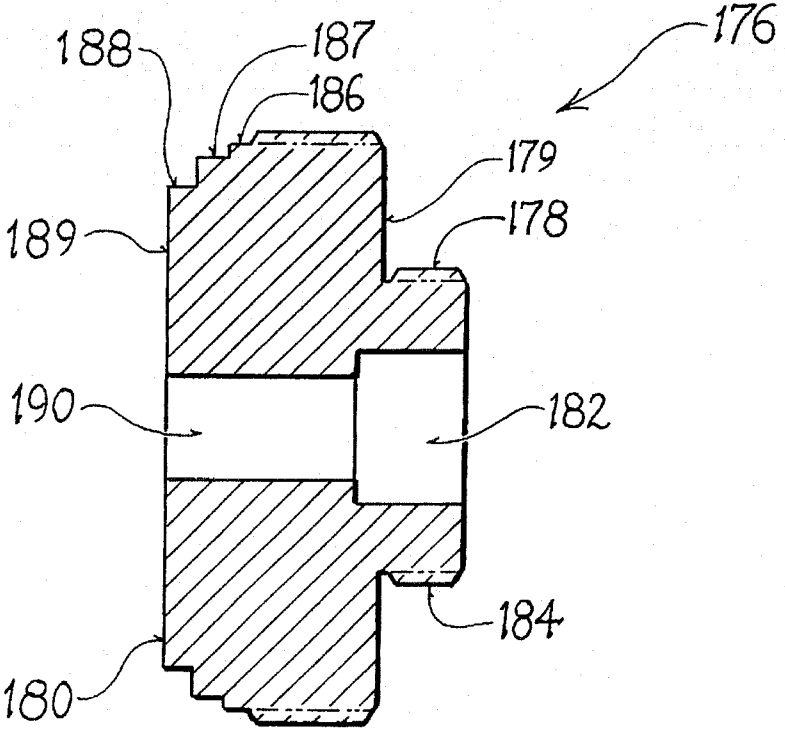
FIG. 16 is a lower end of the upper closure shown in FIG. 15.
Figure 15:
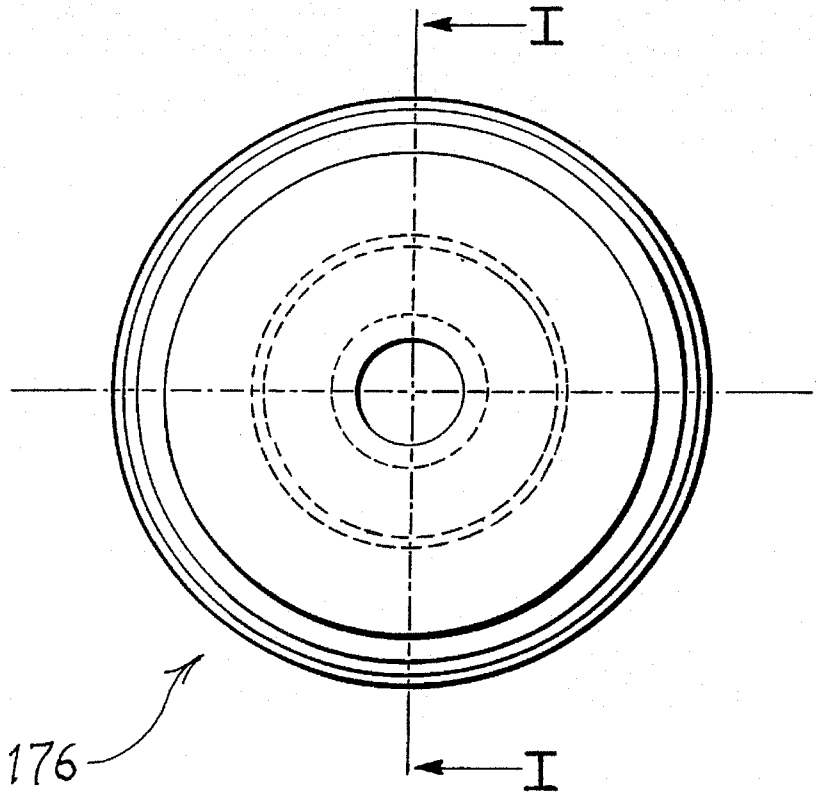

A second embodiment of upper closure 102 is shown in FIGS. 15 and 16. FIG. 15 is the frontal view, and FIG. 16 is a cross-sectional view taken along the line I—I in FIG. 15. Similar to upper closure 102, upper closure 176 includes a protruding circular section 178 and a solid cylindrical section 180. Solid section 180 includes sides 179 and 189 Protruding section 178 includes a circular recess 182, which extends the entire length of section 178 and slightly penetrates section 180. Section 178 further includes mating threads 184 on its outer surface. The outside surface of Section 180 is partially threaded and has annular surfaces 186, 187 and 188. Section 180 further includes a central recess 190 which receives the mating part of bladder bag 104.

Surface 168 is used as a guide surface. As section 180 enters end 140 of pressure cylinder 100, from side 189, surface 180 slides against the inside surface of pressure cylinder 100. This ensures that upper closure 176 is centered as the threaded section of section 180 mates with threaded section 144. This way both pressure cylinder 100 and upper closure 176 are axially aligned. Surface 188 receives one side of spacer 106. As spacer 106 and upper closure 176 mate, recess 130 (FIG. 11) which includes surface 187 is created. As mentioned before, recess 130 houses seal 124. Seal 124 seals the connection between pressure cylinder 100 and upper closure 176. In the present invention, seal 124 is a lip seal.

Either of the two upper closures, 102 or 176, perform three functions. They seal end 140 of pressure cylinder 100, they interface with breech fitting 224, and they connect to bladder bag 104.

Figure 17:
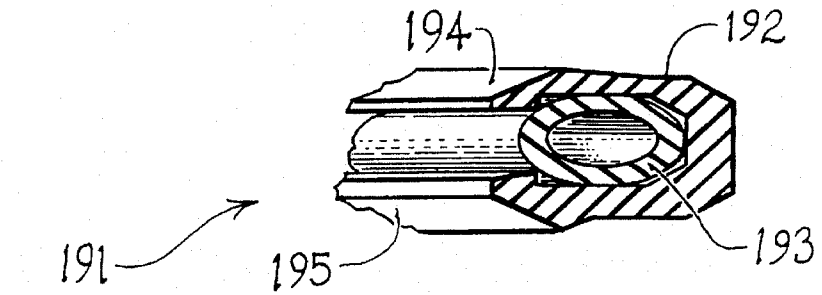
FIG. 17 is a cross-sectional view of a lip seal used in the present invention.

FIG. 17 illustrates the lip seal 191 which is used in the present invention. Lip seal 191 includes O-ring support 192 and O-ring 193. O-ring support 192 includes sides 194 and 195. To slide seal 191 inside a cavity, sides 194 and 195 must be depressed, which they, in turn, depress O-ring 193. Once seal 1 91 is inside the cavity, sides 194 and 195 return to their original position and allow seal 191 to occupy the entire cavity. Seal 191 is readily available and can be obtained from Ball Seal Engineering Company, Incorporated, a California corporation.

Bladder bag 104 is shown in FIG. 18. It is made of a resilient material, such as reinforced rubber, and includes valve 196. It further includes a protruding metallic section 197. The outside surface of section 197 is threaded. Section 197 further includes mating surface 198. The length of Section 197 depends on which embodiment of the upper closure is used. When upper closure 176 is used, length of section 197 is greater than its length when upper closure 102 is used. Valve 196 is used to fill bladder bag 104 with gas. In the present invention, air is used to fill bladder bag 104. Valve 196 further allows the present invention to set the initial resilience or pressure of bladder bag 104. This pressure represents the equilibrium pressure felt by all surfaces inside pressure cylinder 100 before each round of firing. It can be adjusted to obtain the maximum performance from damper 28 (FIG. 11).

If upper closure 102 is used, mating surface 198 mates with surface 174 of upper closure 102. On the other hand, if upper closure 176 is used, section 197 penetrates central space 190 from side 189 and is connected to a nut with in recess 182.

Although, a rubber bladder bag is used in the embodiment of FIG. 10, other resilient mechanisms that can function similar to bladder bag 104 could also be used. One example is a steel spring. In this case, the design of damper 28 must be modified to utilize the steel spring.

Spacer 106 is shown in FIGS. 19 and 20. FIG. 19 is the frontal view of spacer 106, and FIG. 20 is a cross-sectional side view taken along the line C—C in FIG. 19. Spacer 106 is a hollow cylinder. It is placed between upper closure 102 and metering block 108 as seen in FIG. 11. Spacer 106 includes two ends 199 and 200. End 199 abuts surface 174 of upper closure 102 (FIG. 14). End 200 abuts surface 202 of metering block 108 (FIG. 22).

The function of spacer 106 is threefold. First, it mates with surface 174 (FIG. 14) creating recess 130 (FIG. 11). Second, it presses against metering block 108 to ensure it is in tight contact with surface 148 of pressure cylinder 100 (FIG. 12). Finally, the volume inside spacer 106 defines space 118 (FIG. 11).

Metering block 108 is shown in FIGS. 21 and 22. FIG. 21 is the frontal view of metering block 108, and FIG. 22 is a cross-sectional view taken along the line D—D in FIG. 21. Metering block 108 is a plate having two ends 201 and 202. It also includes a central hole 204 and a number of equally spaced passageways 206 which are located around central hole 204. Although, more than one passageway 206 is shown in FIGS. 21 and 22, the actual number of passageway 206 depends on the requirement of the system. The actual number could be one or more passageways. Metering block 108 further includes annular surface 208 which mates with annular surface 148 of pressure cylinder 100.

FIG. 22 further shows that metering block 108 is connected to spring 209. Spring 209 is in the shape of a circular plate and when in place, it blocks part of passageways 206. Bolt 210 is used to connect spring 209 to metering block 108. Spring 209 includes a central hole which allows bolt 210 to pass through and enter central hole 204 of metering block 108.

FIGS. 23 and 24 show a thin metal plate 212 used by the present invention to build spring 209. FIG. 23 is the frontal view of plate 212, and FIG. 24 is a cross-sectional view taken along the line E—E of FIG. 23. Plate 212 includes two faces 214 and 216. It further includes central hole 218. Plate 212 is designed to bend in response to pressure exerted on either of its two faces. Central hole 218 allows plate 212 to be connected to other parts in damper 28. Typically, to secure plate 212, a bolt is passed through central hole 218 which connects to metering block 108 or piston 110. Depending on the application, the diameter of central hole 216 changes.

The number of plates 212 used to make spring 209 depends on the amount of pressure that must be absorbed by damper 28. This pressure is exerted by barrel 22 as it moves in response to the force generated by the explosion of the propellant in the cap of each round. FIG. 22 shows that only one plate 212 is used to build spring 208. However, more than one plate 212 could be used to construct high pressure springs if it is necessary to absorb higher recoil pressures. In this case as shown in FIG. 25, the diameter of the circular plates decreases from one to the next.

FIG. 25 shows an example of a spring used to absorb higher recoil pressure. It includes plates 220, 221, 222, 223 and 224, which are stacked in descending order of their diameters. Although FIG. 25 shows only five plates, this is just one example of high pressure springs.

Figure 26:
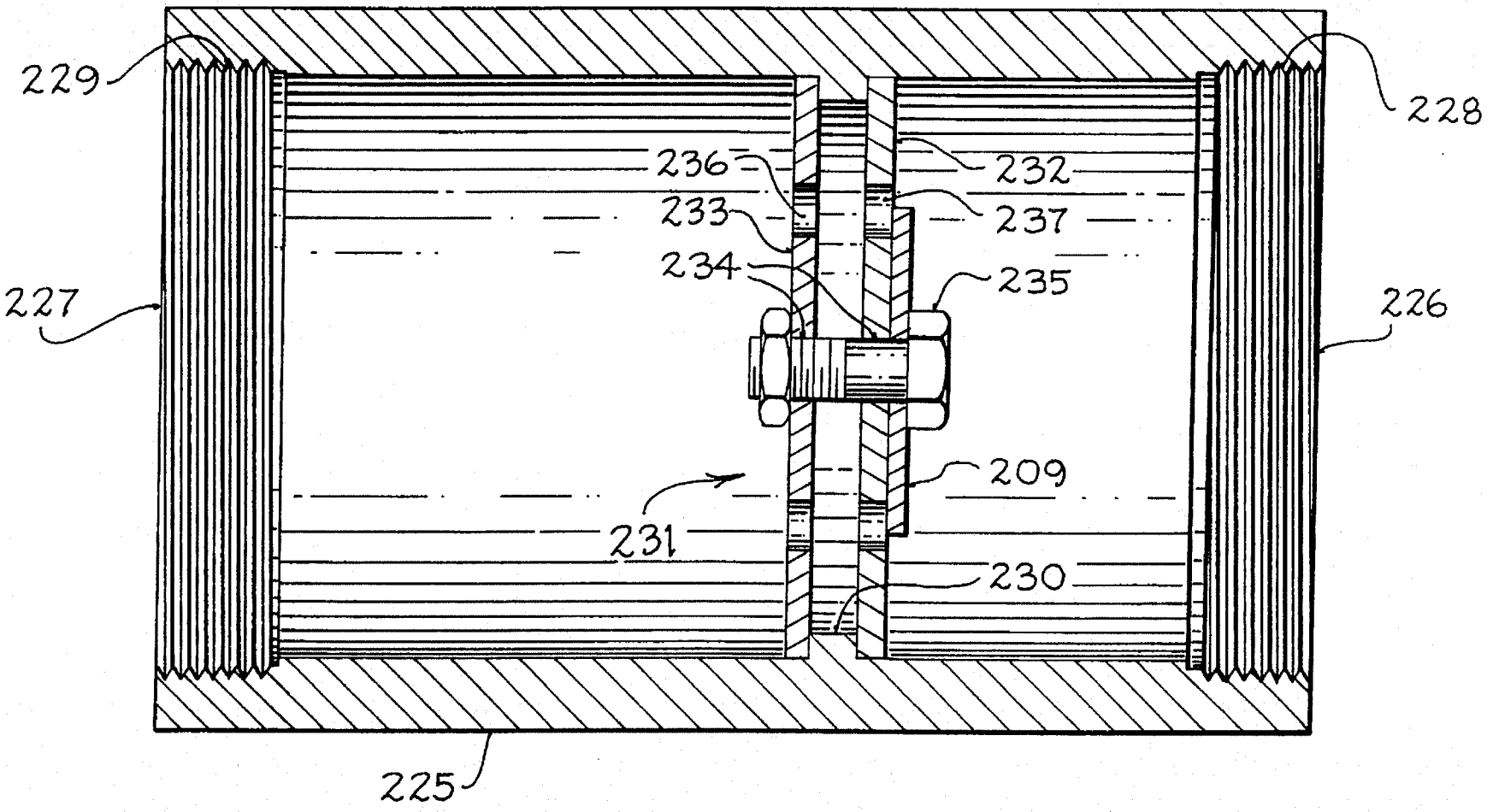
FIG. 26 is a cross-sectional view of a second embodiment of the metering block of FIGS. 20 and 21 attached to a second embodiment of the pressure cylinder in FIG. 12.

A second embodiment of metering block 108 could include two thin metal plates, each having a central hole. They both have one or more passageways. However, they both have equal number of passageways. If this embodiment is used, pressure cylinder 100 must be modified to have an annular lip instead of annular surface 148. Space 106 is no longer needed. FIG. 26 is the cross sectional view of modified housing 100 and the second embodiment of metering block 108.

FIG. 26 includes pressure cylinder 225 which includes annular sides 226 and 227 and threaded sections 288 and 229. It further includes annular lip 230. FIG. 26 also shows the first alternative of metering block 108, which is attached to pressure cylinder 225. Metering block 231 includes plates 232 and 233, each having central space 234. Each of the two plates could also include one or more passageways. In FIG. 26, plate 232 includes two passageways 236 and plate 233 includes two passageways 237. Plates 232 and 233 are secured by bolt 235. FIG. 26 also shows spring 209 connected to plate 232.

A third embodiment as metering block 108 (not shown) could be an integral part of the structure of pressure cylinder 100.

Figure 28:
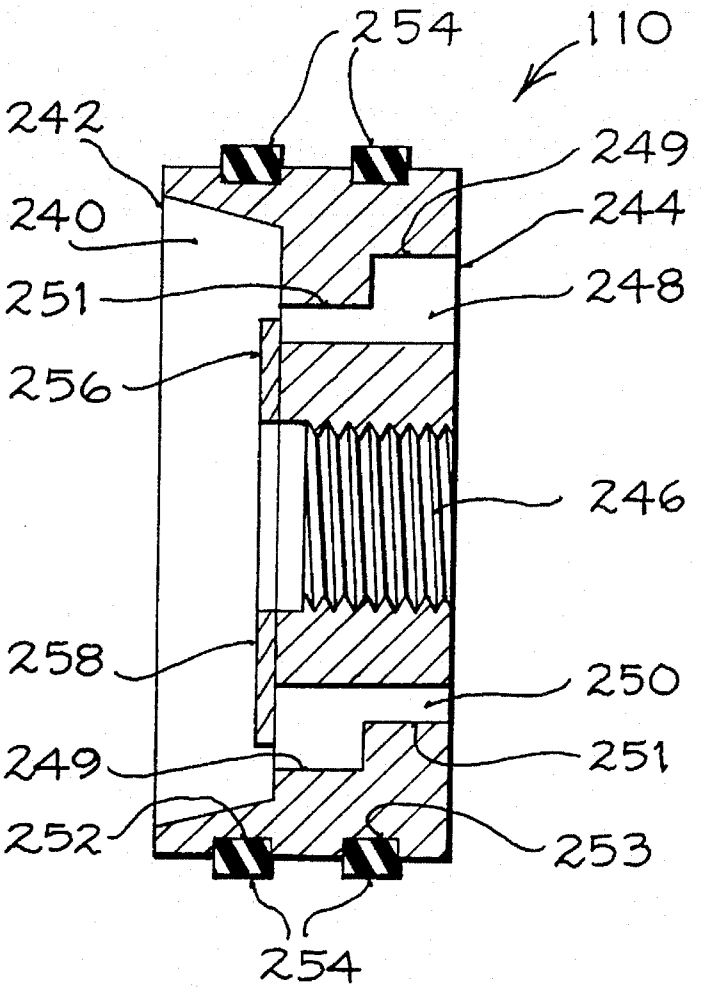
FIG. 28 is a cross-sectional view of the piston of FIG. 27 taken along the line F—F.
Figure 27:
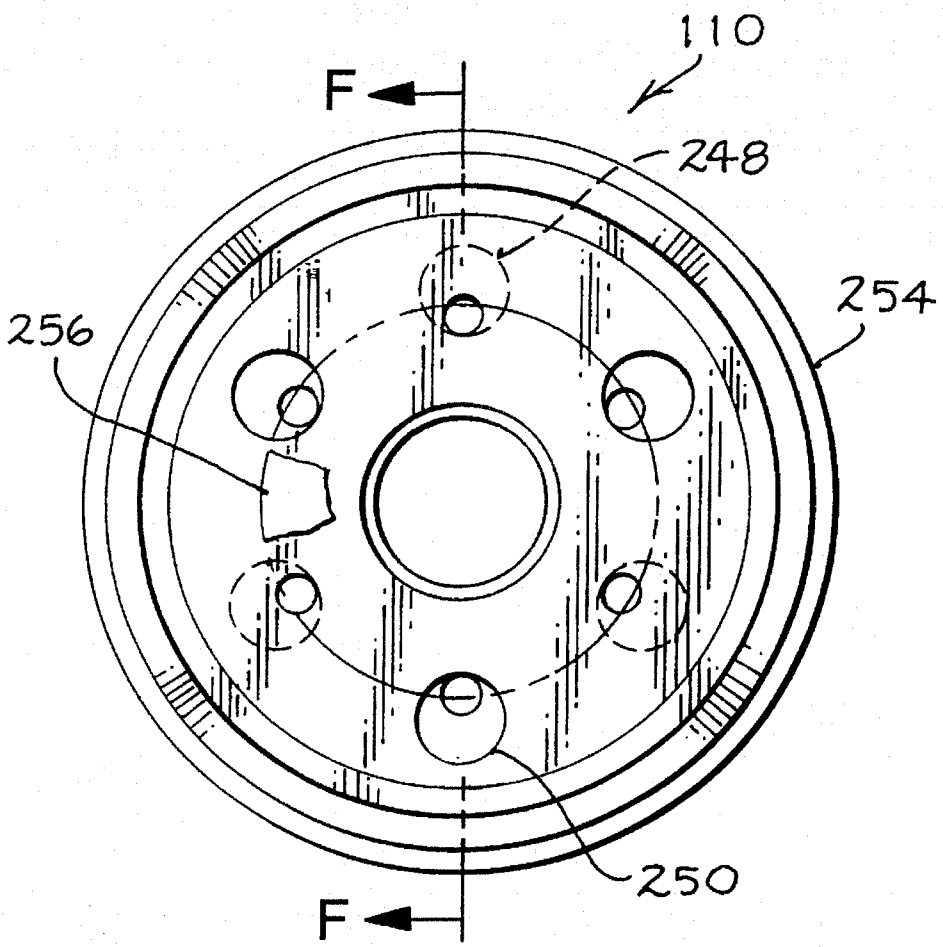
FIG. 27 is an end view of the piston used in the damper of the present invention.

Piston 110 is shown in FIGS. 27 and 28. FIG. 27 is a frontal view of piston 110, and FIG. 28 is a cross-sectional view taken along the line F—F in FIG. 27. Piston 110 is a short solid cylinder having a circular recess 240 on side 242. It also includes central space 246 and passageways 248 and 250 which are located around central space 246. Both passageways 248 and 250 and central space 246 extend from the bottom of recess 240 to side 244. Each of passageways 248 includes bore 249 which extends from side 244 to approximately half of the distance between side 244 and the bottom of recess 240. Each of passageways 248 further includes bore 251 which extends from the end of bore 249 to the bottom of recess 240. Each of passageways 250 include bore 249 and 251 in the reverse order. The inside surface of central space 246 is partially threaded starting from side 244. Piston 110 further includes annular recesses 252 and 253 to house piston ring guides 254.

Although six passageways are shown in FIG. 27, the number of passageways could differ based on the requirement of the mortar system. For example, four to eight passageways can be used for a 120 mm mortar designed according to the present invention. Piston ring guides 254 provide the means to allow piston 110 to move without contacting the inside surfaces of pressure cylinder 100. In the absence of piston ring guides 254, the contact between piston 110, a first metal, and the inside surface of pressure cylinder 100, a second metal, as piston 110 moves could damage the inside surface of pressure cylinder 100.

When piston 110 is not moving, recess 240 defines space 122 (FIG. 11). As piston 110 moves in the direction of metering block 108, the volume of space 122 increases. This, in turn, results in reduction of space 120, which causes liquid to flow into space 122 through passageways 248. As piston retreats to its initial position, the volume of space 122 decreases causing the excess liquid to flow back into space 120 through passageways 250. The function of piston 110 is to generate a retarding force that prevents mortar 20 (FIG. 2) to go into the ground. This will be explained later. This force is generated to counter the recoil force of barrel 22 when a round is fired.

As shown in FIG. 28, piston 110 is also connected to spring 256. Similar to spring 209, one or more of plate 212 (FIG. 24) is utilized to form spring 256. In the embodiment of FIG. 28, spring 256 includes a larger central hole 258. This allows the present invention to use piston shaft 112 to securely hold spring 256 against the bottom of recess 240. This will be further explained next.

Figure 30:
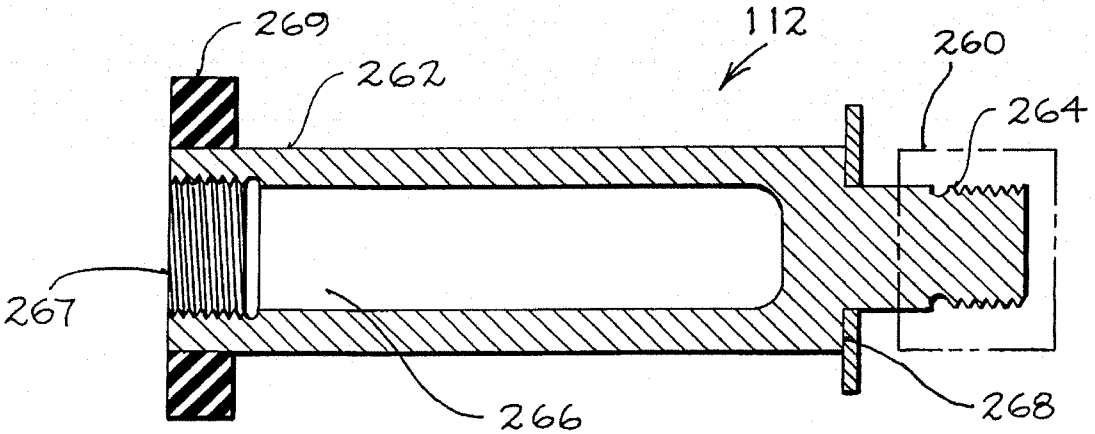
FIG. 30 is a cross-sectional the view of the piston shaft taken along the line G—G.
Figure 29:
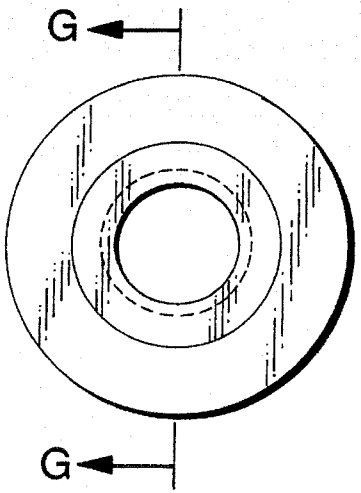
FIG. 29 is an end view of the piston shaft used in the damper of the present invention.

Piston shaft 112 is shown in FIGS. 29 and 30. FIG. 29 is a frontal view of piston shaft 112, and FIG. 30 is a cross-sectional view taken along the line G—G in FIG. 29. Piston shaft 112 includes a protruding part 260 which is connected to a second part 262. Protruding part 260 is a solid cylinder having a circular mating threads 264 on its outside surface. Part 262 is a solid cylinder having a circular recess 266 extending from end 267 to a point near end 268. Circular recess 266 is partially threaded starting from side 267. The threaded section is sufficient to receive the threaded mating section of ball 116. Piston shaft 112 is also connected to washer 269. Washer 269 is made of rubber and acts as a cushion. Once piston shaft 112 entirely slides inside pressure cylinder 100, washer 269 rests against side 280 of bottom closure 114. This prevents piston shaft 112 to slide further inside pressure cylinder 100, which in turn prevents piston 110 to collide with metering block 112. By providing circular recess 266, a big portion of the mass of piston shaft 112 is removed, thus reducing its total weight.

To connect piston shaft 112 to piston 110, threaded section 264 must mate with the threaded portion of recess 246. As piston shaft 112 slightly connects to piston 110, annular surface 268 presses against spring 258 and holds it in its place. Annular surface 268 abuts the side of spring 258 which is facing side 242 of piston 110.

Figure 32:
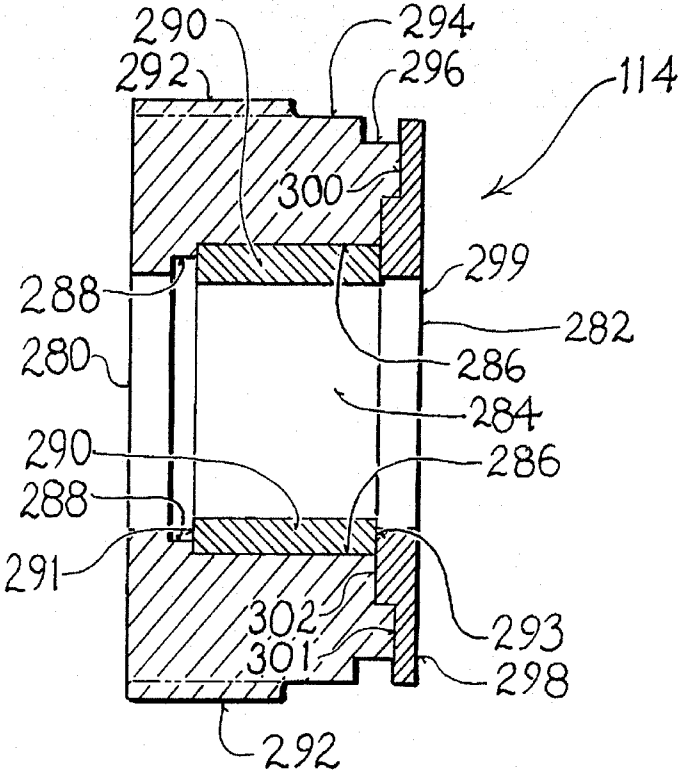
FIG. 32 is a cross-sectional view of the bottom closure of FIG. 31, taken along the line H—H.
Figure 31:
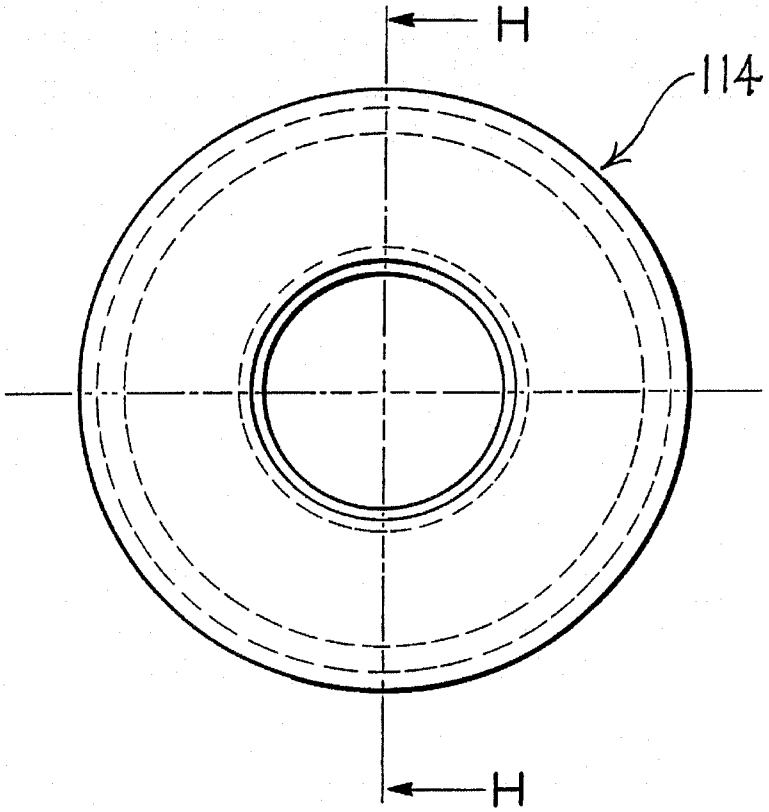
FIG. 31 the bottom closure used in the damper of the present invention.

Bottom closure 114 is shown in FIGS. 31 and 32. FIG. 31 is the frontal view, and FIG. 32 is a cross-sectional view taken along the line H—H in FIG. 31. Bottom closure 114 is a solid cylindrical section having a central circular recess 284 extending from side 280 to side 282. Side 282 of bottom closure 114 mates with a circular retainer plate 298. Retainer 298 includes surfaces 299 and 300. Surface 300 includes surfaces 301 and 302. The inside surface of central recess 284 includes an annular recess 286 and annular surface 288. The outer surface of bottom closure 114 includes mating thread ed section 292 which extends from side 280 to approximately half of the height of bottom closure 114. The outer surface further includes first and second annular surfaces 294 and 246, respectively.

Bottom closure 114 also includes bushing 290 which is housed in recess 286. Bushing 290 includes side 291 and 293. The cavity created by surface 294 and surface 301 of retainer plate 298 houses seal 126. The cavity created by surface 288 and 291 of bushing 290 houses seal 128. Both seals 126 and 128 are similar to the lip seal shown in FIG. 17. Surface 302 of retainer plate 298 rests on side 292 of bushing 290 to keep bushing 290 in its place.

Central space 284 provides a space for piston shaft 112 to protrude inside pressure cylinder 100. Seal 128 ensures that liquid does not flow out of pressure cylinder 100 as piston shaft 112 moves. Seal 126 ensures that the connection between pressure cylinder 100 and bottom closure 114 is sealed.

Figure 33:
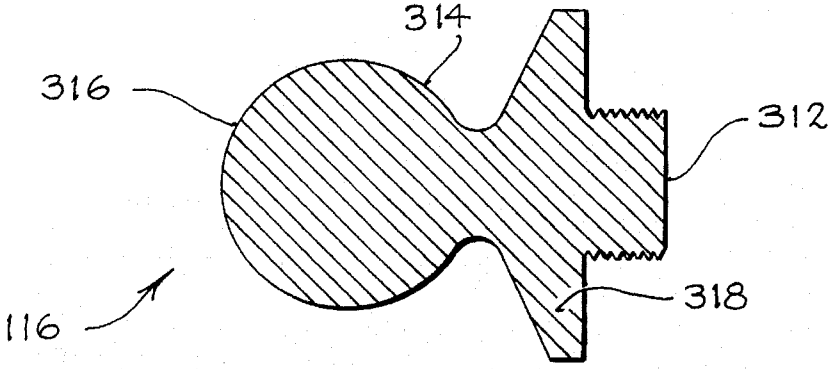
FIG. 33 shows the ball used in the damper of the present invention which engages the base plate.

FIG. 33 shows ball 116. Ball 116 includes a protruding end 31 2 and a solid end 314. Solid end 314 includes a solid ball 316 which is connected to pieces 318. The outside surface of mating end 312 is threaded and mates with the threaded section of recess 266 of piston shaft 112. Solid ball 316 rests in a mating surface in base-plate 32 (FIG. 2).

To reduce the weight of damper 28, the present invention manufactures pressure cylinder 100, upper closure 102 or 176, spacer 106, metering block 108 or 231, piston 110, and bottom closure 112 out of aluminum alloy. A ceramic insert is placed inside passageways 206 (FIG. 22) and 248 and 250 (FIG. 28) to prevent erosion. However, piston shaft 112 and ball 116 are made of steel. This is to ensure that piston shaft 112 and ball 116 can withstand the force that they have to relay to the ground. Although, this force is less than the force by which barrel 12 initially moves, its magnitude is still substantial.

Referring to FIG. 11, and example of assembling damper 28 is as follows:

1) insert metering block 108 into pressure center 100 such that annular surface 208 rests on annular surface 148,
2) insert spacer 102 inside pressure center 100 such that one side rests on end 202 of metering block 108,
3) connect bladder bag 104 to upper closure 102 such that mating surface 198 mates with side 174,
4) insert upper closure 102 in pressure cylinder 100 from side 174 and tightly connect the two pieces such that threaded section of section 166 tightly mates with threaded section 144,
5) pass piston shaft 112 through central circular recess 284 of the bottom closure 114,
6) connect piston shaft 112 to piston 110 such that the threaded section of the protruding part 260 mates with the threaded section of central space 246 of piston 110,
7) connect bottom closure 114 to end 142 of the pressure cylinder 100 such that threaded section 292 tightly mates with threaded section 146 of the pressure cylinder 110, and
8) connect ball 116 to the piston shaft 112 such that the threaded section of the protruding mating end 312 mates with the threaded section of recess 266.

The above list is not intended to be the only method of assembling damper 28. Other methods of assembling damper 28 is obvious to one knowledgeable in the art.

Figure 34:
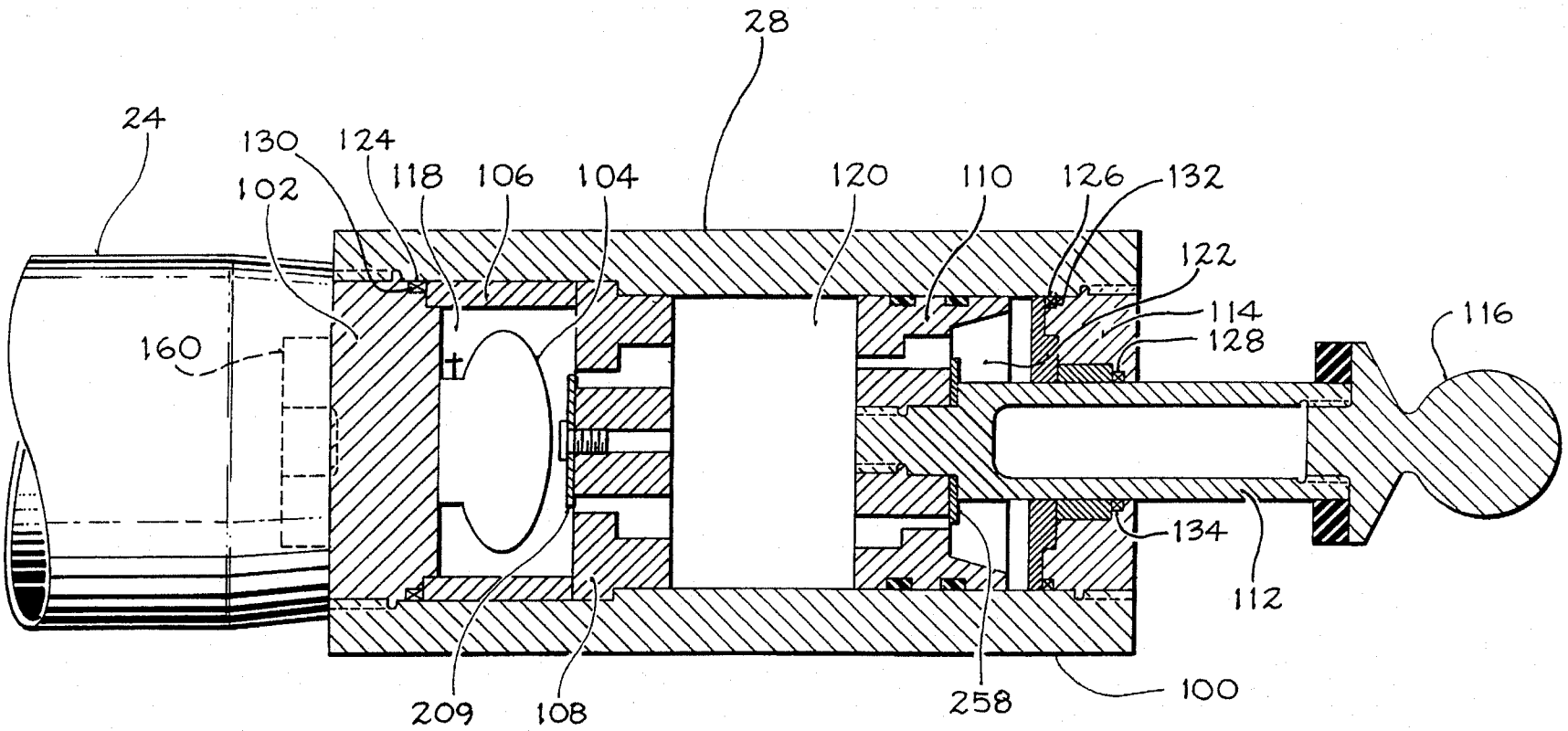
FIG. 34 is a cross-sectional view of the breech fitting and damper assembly of the present invention.

FIG. 34 illustrates damper 28 of embodiment of FIG. 10 which is connected to breech fitting 24. To connect damper 28 to breech fitting the protruding section 160 of upper closure 102 is inserted inside recess 74 of breech fitting 24 such that threaded section 164 mates with the threaded part of recess 74. An alternative method of connecting breech fittings 24 to damper 28 is to place a circular metal plate between side 70 and side 1 61 or 179 of upper closures 102 or 176, respectively. The circular plate would include a central opening sufficiently large to allow section 164 or 184 to pass through.

An alternative embodiment of damper 28 includes a much longer pressure cylinder 100 with a piston having no passageway. In this embodiment the extra length of pressure cylinder 100 increases space 118. Therefore, as pressure cylinder 100 moves in the direction of barrel 22, the liquid inside space 120 enters space 118. Since piston 110 does not have any passageways, no liquid enters space 122. However, since space 118 is much larger than the space 118 in embodiment of FIG. 11, the oil which would have flown in space 122 is now flowing in space 118. Thus, the possibility of hydraulic lock is eliminated by increasing the volume of space 118. The disadvantage of the above alternative is that since pressure cylinder 100 is larger this adds to the total weight of damper 28.

The function of damper 28 (FIG. 11) is threefold. It lowers the force exerted by barrel 22 into the base and ground during each round of firing, it absorbs the recoil energy of barrel 22, and it returns barrel 22 to its original position for further rounds. By dampening the recoil movement of barrel 22, damper 28 prevents mortar 20 to literally jump up in response to the force exerted by barrel 22 when it moves. This eliminates the need to ballast mortar 20 with sand bags. In the presently available heavy steel mortar systems, sand bags are often required to dampen the recoil movement of the barrel. Despite using sand bags, these mortars still jump up after each round of firing. Another function of damper 28 is to provide a mechanism to return barrel 22 to its original position for further rounds of firing.

As mentioned before, the mortar, according to the present invention, includes bipod 30 and base-plate 32. Both parts are designed using light weight material to reduce their weights. For example, the bipod and base-plate for a 120 mm mortar built according to the present invention weighs less than 40 pounds each. The mechanical design of bipod 30 is similar to the existing design. On the other hand, the base-plate is designed to dissipate the heat generated by dampening mechanism. Otherwise, it is designed similar to the existing base-plate designs.

Next the operation of mortar 20 (FIG. 2), according to the present invention, will be described. In this process, we will be referring to FIGS. 2 and 11. Referring to FIG. 2, a round to be fired is manually dropped down barrel 22. The round hits firing pin 26, causing the explosion of the propellant. The force of explosion causes the round to leave muzzle 50 at a selected trajectory angle. The explosion also causes barrel 22 to move in the opposite direction of the exiting round. The displacement of barrel 22 occurs in a very short period of time, namely 5 milliseconds. However, it moves with a tremendous amount of force, approximately 240,000 pounds. Since barrel 22 is connected to damper 28, its movement forces pressure cylinder 100 to move in the same direction. In this process, pressure cylinder 100 moves from a firing position to a full recoil position. The firing position is the position of pressure cylinder 100 before the round is dropped inside barrel 28. The full recoil position is the position of pressure cylinder 100 after a round is fired, before recoiling barrel 22.

Referring to FIG. 11, the movement of pressure cylinder 100 causes piston 110 to move toward metering block 108. This reduces the volume of space 120. As the volume of space 120 reduces, liquid media is forced through passageways 206 and 248 (FIGS. 22 and 28, respectively) into spaces 118 and 122. The amount of the liquid flowing into spaces 118 and 122 are proportional to the pressure built up in space 120. This pressure is directly proportional to the force that barrel 22 moves after the explosion. The flow of liquid through passageways 206 and 238 is controlled by springs 209 and 256 (FIGS. 22 and 28, respectively). Springs 209 and 256 deflect in response to the pressure inside space 120. In operation, the pressure causes the liquid to flow through passageways 206 and 248 with a proportional force. This force causes spring 209 and 258 to deflect and allow more liquid to flow into spaces 118 and 122. The liquid continues to flow until the pressure inside space 120 stabilizes to a maximum acceptable pressure. The maximum acceptable pressure is substantially less than the pressure exerted by the movement of barrel 22. The difference between the pressure due to the movement of barrel 22 and the maximum acceptable pressure is absorbed by damper 28. This enables damper 28 to substantially reduce the force exerted into the ground.

The recoil energy absorbed in the above process is converted into heat. The heat is generated by the movement of liquid molecules through passageways 206 and 248. The generated heat dissipates through the surface area of cylinder 100. The heat is also passed to base-plate 36 which must be able to dissipate it.

Since the volume of space 118 is constant, the incoming liquid depresses bladder bag 104. As the bag depresses, it stores potential energy. This energy is used to return barrel 22 to its original position for further rounds.

After the explosion, barrel 22 must be returned to its original position. This means that pressure cylinder 100 must be returned to its firing position. Once the pressure inside pressure cylinder stabilizes, bladder bag 104 starts to expand. The potential energy stored in bladder bag 104 forces the liquid media in space 118 to flow into space 120. The force by which the liquid flows into space 120 from space 118 causes a reactive force in the opposite direction. The reactive force acts on the surfaces of metering block 108 and top closure 102 and pushes pressure cylinder 100 back to its firing position. This in effect pushes barrel 22 back to its original position for further rounds of firing.

Thus, the present invention has been described in conjunction with a lightweight mortar system. As stated above, the present invention generally applies to the muzzle loading and breech loading gun systems. Other variations of the present invention are obvious to one knowledgeable in the art. For example, a gun system can only use the barrel described in the present invention without utilizing the damper. Another alternative is to mount the gun system according to the present invention on a special vehicle. For example, a light mortar can be mounted on a special vehicle or a breech loading gun system can be mounted on a ship. Therefore, the present invention is not to be limited except by the appended claims.

What is claimed is:

1. A gun system comprising: a barrel having a cylindrical liner enclosed within an outer sleeve, and damper means for substantially reducing recoil force and absorbing recoil energy of said barrel and being axially aligned with said barrel, said outer sleeve comprising layers of wound carbon fiber impregnated with thermally stable organic polymer, wherein the damper means includes a housing filled with a liquid medium; a metering block that divides the housing into a first space and a second space; and a piston supported in the second space, the metering block defining at least one first passageway extending between the first and second spaces for flow of the liquid medium at least in a direction from the second space to the first space, and including first resilient spring means, at least partially covering the at least one first passageway for regulating flow of the liquid medium from the second space to the first space.

2. The system of claim 1 wherein said liner comprises titanium.

3. The system of claim 1 wherein said liner comprises silicon carbide reinforced carbon.

4. The system of claim 1, wherein said outer sleeve has a muzzle end and is tapered toward said muzzle end.

5. The system of claim 1, wherein said damper means comprises:

said housing having a first and a second end;

a first cap attached to said first end of said housing;

the metering block having first and second metering block sides and being positioned in said housing to define the first space between said metering block and said first cap, said metering block further having the at least one first passageway extending from said first metering block side to said second metering block side;

a piston shaft attached to said piston;

a second cap attached to said second end of said housing, said second cap having a central opening, and said piston shaft passing through said central opening;

the piston having first and second piston sides and being positioned in said housing in said second space between said second cap and said metering block, said housing being supported on said piston for movement relative to the piston between a firing position and a full recoil position; and resilient means positioned in said first space for moving said housing relative to the piston from said full recoil position to said firing position.

6. The system of claim 5 further comprising a spacer housed in said housing between said first cap and said metering block.

7. The system of claim 5 wherein said metering block is an integral part of said housing.

8. The system of claim 5, wherein said piston further comprises at least one second passageway extending from said first piston side to said second piston side.

9. The system of claim 5, wherein said resilient means comprises a bladder bag.

10. The system of claim 5, wherein said resilient means further comprises means for adjusting its initial resilience.

11. The system of claim 5, wherein said damper further comprises a ball attached to said piston shaft.

12. The system of claim 1, further comprising a breech having a first breech end attached to said barrel and a second breach end attached to said damper.

13. The system of claim 12, wherein said breech comprises an outer surface, said outer surface being tapered toward said damper starting from a point between said first and second breech ends.

14. The system of claim 12, wherein said outer sleeve covers said outer surface of said breech.

15. A system of claim 1, wherein the spring means comprises at least one resilient plate.

16. A system of claim 15, wherein the spring means includes a plurality of resilient plates stucked on top of each other.

17. A gun system comprising a barrel having a cylindrical liner enclosed within an outer sleeve, said outer sleeve comprising layers of wound carbon fiber impregnated with thermally stable organic polymer, the gun system further comprising a breech having a first breech side attached to said barrel and a second breech side, wherein said breech comprises an outer surface, said outer surface tapering toward said second breech side, and said outer sleeve covering said tapering outer surface of said breech.

18. The system of claim 17 wherein said liner comprises titanium.

19. A gun system comprising damper means for substantially reducing recoil force and absorbing recoil energy of said system, said damper including:

a housing having a first and a second end, said housing being filled with a liquid medium;

a first cap coupled to said first end of said housing;

a metering block having first and second metering block sides and being positioned in said housing to define a first space between said metering block and said first cap, said metering block further having at least one first passageway extending from said first metering block end to said second metering block end;

a piston having first and second piston sides and being positioned in said second space for movement relative to said housing between a firing position and a full recoil position;

the at least one first passageway permitting the liquid medium to flow at least in a direction from the second space to the first space;

a first spring means at least partially covering the at least one first passageway for regulating flow of the liquid medium from the second space to the first space;

a piston shaft attached to said piston;

resilient means positioned in said first space for urging said housing from said full recoil position to said firing position; and a second cap attached to said second end of said housing, said second cap having a central opening, and said piston shaft passing through said central opening.

20. The system of claim 19 further comprising a spacer housed in said housing between said first cap and said metering block.

21. The system of claim 19 wherein said metering block is an integral part of said housing.

22. The system of claim 19, wherein said piston defines at least one second passageway extending from said first piston side to said second piston side.

23. The system of claim 22, wherein said damper further comprises a second spring means connected to said piston, said second spring means covering at least a portion of said at least one second passageway.

24. The system of claim 19, wherein said resilient means comprises a bladder bag.

25. The system of claim 19, wherein said damper means includes adjustment means for adjusting the initial resilience of the resilient means.

26. The system assembly of claim 19, wherein said damper further comprises a ball attached to said piston shaft, at an opposite end of the piston shaft to the piston.

27. A gun system comprising:

a barrel having a cylindrical sleeve, said sleeve comprising layers of wound carbon fiber impregnated with thermally stable organic polymer, and damper means for substantially reducing recoil force and absorbing recoil energy of said barrel and being engaged and axially aligned with said barrel, wherein the damper means includes a housing filled with a liquid medium and having a metering block that divides the housing into a first space and a second space, and wherein a piston is housed in the second space for movement relative to the metering block, the metering block defining at least one first passageway extending between the first and second spaces for flow of the liquid medium at least in a direction from the second space to the first space, and including first resilient spring means, at least partially covering the at least one passageway for regulating flow of the liquid medium from the second space to the first space.

28. The system of claim 27, wherein said sleeve has a muzzle end and is tapered toward said muzzle end.

29. The system of claim 27, wherein said damper comprises:

the housing, the housing having a first and a second end;

a first cap coupled to said first end of said housing;

the metering block, the metering block having first and second metering block sides and being positioned in said housing to define the first space between said metering block and said first cap;

the piston having first and second piston sides and defining at least one second passageway extending from the first piston side to the second piston side, aid housing being supported on said piston for movement between a firing position and a full recoil position;

a piston shaft attached to said piston;

resilient means connected to said housing for moving said housing relative to the piston from said full recoil position to said firing position; and a second cap attached to said second end of said housing, said second cap having a central opening, said piston shaft passing through said central opening.

30. The system of claim 29, further comprising a spacer housed in said housing between said first cap and said metering block.

31. The system of claim 27 wherein said metering block is an integral part of said housing.

32. The system of claim 29, wherein said damper further comprises a second resilient spring means mounted on said piston to cover at least a portion of said at least one second passageway.

33. The system of claim 29, wherein said resilient means comprises a bladder bag.

34. The system of claim 29, wherein said damper means further comprises adjustment means for adjusting the initial pressure of the resilient means.

35. The system of claim 29, wherein said damper further comprises a ball attached to said piston shaft at an opposite end of the shaft to the piston.

36. The system of claim 27 wherein said barrel further comprises a cylindrical liner enclosed within said sleeve.

37. The system of claim 36 wherein said liner comprises titanium.

38. The system of claim 36, wherein said sleeve has a muzzle end and is tapered toward said muzzle end.

39. The system of claim 36, further comprising a breech having a first breach end attached to said barrel and a second breach end attached to said damper.

40. The system of claim 39, wherein said breech comprises an outer surface, said outer surface being tapered toward said damper.

41. The system of claim 39, wherein said sleeve covers said outer surface of said breech.

42. A gun system comprising:

a barrel having a cylindrical liner enclosed within an outer sleeve, and damper means for substantially reducing recoil force and absorbing recoil energy of said barrel and being axially aligned with said barrel, said outer sleeve comprising layers of wound carbon fiber impregnated with thermally stable organic polymer, wherein the damper means includes a housing filled with a liquid medium;

a metering block that divides the housing into a first space and a second space; and a piston movably supported in the second space, the metering block defining at least one passageway extending between the first and second spaces, wherein the at least one passageway permits the liquid medium to flow at least in a direction from the second space to the first space, the damper means further including resilient spring means at least partially covering the at least one passageway for regulating flow of the liquid medium from the second space to the first space, the damper means further including a bladder housed in the first space.

43. A system of claim 42, wherein the bladder includes a valve, and is filled with a gas.

* * * * *